US009975171B2

(12) United States Patent
Waniuk et al.

(10) Patent No.: US 9,975,171 B2
(45) Date of Patent: May 22, 2018

(54) METHODS AND SYSTEMS FOR SKULL TRAPPING

(75) Inventors: Theodore A. Waniuk, Lake Forest, CA (US); Quoc Tran Pham, Anaheim, CA (US); Joseph Stevick, Olympia, WA (US); Sean Timothy O'Keeffe, Tustin, CA (US); Christopher D. Prest, San Francisco, CA (US); Joseph C. Poole, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 565 days.

(21) Appl. No.: 14/386,495

(22) PCT Filed: Mar. 22, 2012

(86) PCT No.: PCT/US2012/030170

§ 371 (c)(1),
(2), (4) Date: Jun. 11, 2015

(87) PCT Pub. No.: WO2013/141866

PCT Pub. Date: Sep. 26, 2013

(65) Prior Publication Data

US 2015/0375296 A1 Dec. 31, 2015

(51) Int. Cl.
*B22D 17/20* (2006.01)
*B22D 17/10* (2006.01)
(Continued)

(52) U.S. Cl.
CPC ..... *B22D 17/203* (2013.01); *B22D 17/04* (2013.01); *B22D 17/10* (2013.01); *B22D 17/14* (2013.01);
(Continued)

(58) Field of Classification Search
CPC .. B22D 17/007; B22D 17/10; B22D 17/2023; B22D 17/203; B22D 17/22
(Continued)

(56) References Cited

U.S. PATENT DOCUMENTS 5,288,344 A 2/1994 Peker et al.
5,368,659 A 11/1994 Peker et al.
(Continued)

FOREIGN PATENT DOCUMENTS

EP 0718059 6/1996
EP 0897768 2/1999
(Continued)

OTHER PUBLICATIONS

Inoue et al., "Bulk amorphous alloys with high mechanical strength and good soft magnetic properties in Fe—TM—B (TM=IV-VIII group transition metal) system," *Appl. Phys. Lett*, 1997, vol. 71, No. 4, pp. 464-466.
(Continued)

*Primary Examiner* — Kevin E Yoon
(74) *Attorney, Agent, or Firm* — Brownstein Hyatt Farber Schreck, LLP

(57) ABSTRACT

Disclosed are systems and methods for mechanically reducing an amount of the skull material in a finished, molded part formed from amorphous alloy using an injection molding system. Skull material of molten amorphous alloy can be captured in a trap before molding such material. A cavity can be provided in the injection molding system to trap the skull material. For example, the cavity can be provided in the mold, the tip of the plunger rod, or in the transfer sleeve. Alternatively, mixing of molten amorphous alloy can be induced so that skull material is reduced before molding. A plunger and/or its tip can be used to induce mixing (e.g., systematic movement of plunger rod, or a shape of its tip). By minimizing the amount of skull material in the finished, molded part, the quality of the part is increased.

23 Claims, 9 Drawing Sheets

(51) Int. Cl.

| | |
|---|---|
| ***B22D 17/22*** | (2006.01) |
| ***B22D 17/04*** | (2006.01) |
| ***B22D 17/14*** | (2006.01) |
| ***B22D 45/00*** | (2006.01) |

(52) U.S. Cl.
CPC ..... *B22D 17/2023* (2013.01); *B22D 17/22* (2013.01); *B22D 45/00* (2013.01)

(58) Field of Classification Search
USPC ..... 164/113, 312, 900
See application file for complete search history.

(56) References Cited

U.S. PATENT DOCUMENTS

| | | | | |
|---|---|---|---|---|
| 5,579,825 | A * | 12/1996 | Shibata | B22D 17/007 164/113 |
| 5,618,359 | A | 4/1997 | Lin et al. | |
| 5,730,201 | A * | 3/1998 | Rollin | B22D 17/10 164/113 |
| 5,735,975 | A | 4/1998 | Lin et al. | |
| 6,021,840 | A | 2/2000 | Colvin | |
| 6,325,868 | B1 | 12/2001 | Kim et al. | |
| 7,575,040 | B2 | 8/2009 | Johnson | |
| 7,618,499 | B2 | 11/2009 | Johnson et al. | |
| 7,806,997 | B2 | 10/2010 | Demetriou et al. | |
| 8,376,026 | B2 * | 2/2013 | Zheng | B22D 17/007 164/113 |
| 8,480,864 | B2 | 7/2013 | Farmer et al. | |
| 8,529,712 | B2 | 9/2013 | Demetriou et al. | |
| 2011/0011553 | A1 * | 1/2011 | Shibata | B22C 9/082 164/271 |

FOREIGN PATENT DOCUMENTS

| | | | |
|---|---|---|---|
| JP | 63144852 | A * | 6/1988 |
| JP | H08187566 | | 7/1996 |
| JP | H09295119 | | 11/1997 |
| JP | H09323146 | | 12/1997 |
| JP | H11123519 | | 5/1999 |
| JP | 2001303218 | | 10/2001 |
| JP | 2004114058 | | 4/2004 |
| JP | 2004230444 | | 8/2004 |
| JP | 2004268067 | | 9/2004 |
| JP | 2005059044 | A * | 3/2005 |
| JP | 2008272787 | | 11/2008 |
| JP | 2009190074 | | 8/2009 |
| JP | 2011056585 | | 3/2011 |
| JP | 2012040599 | | 3/2012 |
| KR | 20070108585 | A * | 11/2007 |
| WO | 2011091520 | | 8/2011 |

OTHER PUBLICATIONS

Shen et al., "Bulk Glassy $Co_{43}FE_{20}TA_{5.5}B_{31.5}$ Alloy with High Glass-Forming Ability and Good Soft Magnetic Properties," *Materials Transactions*, 2001 The Japan Institute of Metals, vol. 42, No. 10 p. 2136-2139.

Wiest a. et al., "Injection Molding Metallic Glass", Scripta Materialia, Elsevier, Amsterdam, NL, vol. 60, No. 3, Feb. 1, 2009.

International Search Report and Written Opinion, dated Apr. 3, 2013, PCT/ISA/210, PCT/ISA/220, PCT/ISA/237.

* cited by examiner

PRIOR ART

PRIOR ART

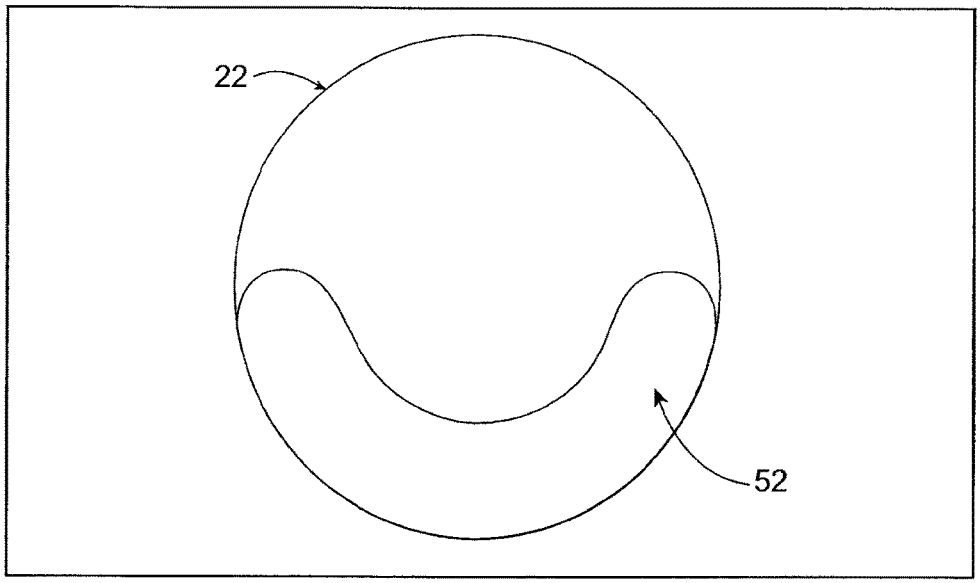
FIGURE 7
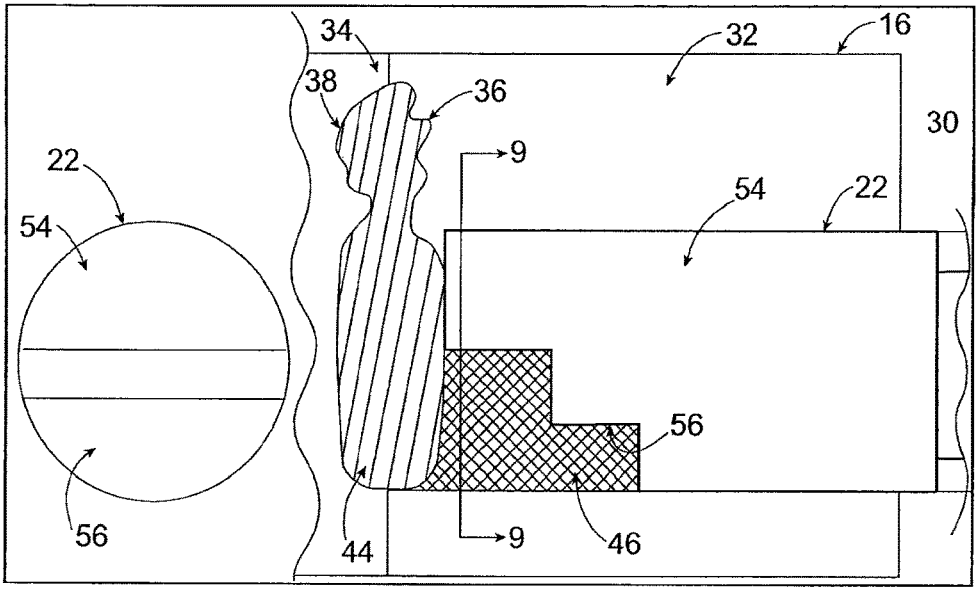
FIGURE 9
FIGURE 8

SKULL SHAVING

METHODS AND SYSTEMS FOR SKULL TRAPPING

FIELD

The present disclosure is generally related to melting and molding amorphous alloy material and minimizing skull material presence in molded products.

BACKGROUND

After heating and melting amorphous alloys, crystals or skull material can form therein if the material is not uniformly heated to a high temperature (to completely melt) resulting in a molted pool with a skull or crystals formed at any interface between the molten material and the container in which it is being melted (e.g., at the bottom). Molding with skull material in amorphous alloys can diminish the final quality of the part after it is formed and molded and degrade its mechanical properties.

Reducing the amount of skull or crystallized material in molded parts will, accordingly, increase their quality, including but not limited to: strength related properties, cosmetic properties, corrosion resistance, and amorphous uniformity.

SUMMARY

A proposed solution according to embodiments herein for improving molded objects or parts is to use bulk-solidifying amorphous alloys.

One aspect includes a plunger configured for use in an injection molding system and configured to move molten amorphous alloy material into a mold. The plunger includes a tip with a cavity therein configured to trap skull material from the molten amorphous alloy and within the tip during injection.

Another aspect includes an injection molding system including a melt zone configured to melt meltable amorphous alloy material received therein, a mold for molding molten amorphous alloy material, and a plunger rod configured to move molten amorphous alloy material from the melt zone and into a mold. The injection molding system further includes a cavity configured to trap skull material from the molten amorphous alloy so as to substantially reduce an amount of the skull material in a finished, molded part.

Yet another aspect includes a method of making a bulk amorphous alloy part including: providing an injection molding apparatus with a melt zone, a plunger, and a mold; providing an amorphous alloy material to be melted within the melt zone; applying a vacuum to the apparatus; melting the amorphous alloy material in the melt zone; moving the molten amorphous alloy material, after melting, into the mold using the plunger; trapping at least part of the molten amorphous alloy material in a cavity of the injection molding apparatus; and molding the material into the bulk amorphous alloy part. The trapped molten amorphous alloy material in the cavity includes skull material from the molten amorphous alloy, so that the bulk amorphous alloy part has a reduced amount of hardened skull material therein.

Another aspect includes a plunger configured for use in an injection molding system and configured to move molten amorphous alloy material into a mold. The plunger is configured to induce mixing of molten amorphous alloy material before entering the mold.

Yet another aspect includes a method of making a molded part including: providing an injection molding apparatus with a melt zone, a plunger, and a mold; providing an amorphous alloy material to be melted within the melt zone; applying a vacuum to the apparatus; melting the amorphous alloy material in the melt zone; moving the molten amorphous alloy material, after melting, into the mold using the plunger; and molding the material into the molded part. The moving of the molten amorphous alloy material using plunger induces mixing of molten amorphous alloy material before entering the mold, such that the molded part has a reduced amount of skull material.

BRIEF DESCRIPTION OF THE DRAWINGS

FIG. 7 illustrates a cross-sectional view of an alternate design taken along line 6-6 in FIG. 5 of a tip of a plunger as shown in FIG. 5 that may be used in an injection molding system, in accordance with yet another embodiment.

FIGS. 8 and 9 illustrate a detailed, sectional and cross-sectional view taken along line 9-9 in FIG. 5, respectively, of a tip of a plunger and mold associated with the injection molding system shown in FIG. 3, in accordance with another embodiment.

DETAILED DESCRIPTION

All publications, patents, and patent applications cited in this Specification are hereby incorporated by reference in their entirety.

The articles "a" and "an" are used herein to refer to one or to more than one (i.e., to at least one) of the grammatical object of the article. By way of example, "a polymer resin" means one polymer resin or more than one polymer resin. Any ranges cited herein are inclusive. The terms "substantially" and "about" used throughout this Specification are used to describe and account for small fluctuations. For example, they can refer to less than or equal to ±5%, such as less than or equal to ±2%, such as less than or equal to ±1%, such as less than or equal to ±0.5%, such as less than or equal to ±0.2%, such as less than or equal to ±0.1%, such as less than or equal to ±0.05%.

Bulk-solidifying amorphous alloys, or bulk metallic glasses ("BMG"), are a recently developed class of metallic materials. These alloys may be solidified and cooled at relatively slow rates, and they retain the amorphous, non-crystalline (i.e., glassy) state at room temperature. Amorphous alloys have many superior properties than their crystalline counterparts. However, if the cooling rate is not sufficiently high, crystals may form inside the alloy during cooling, so that the benefits of the amorphous state can be lost. For example, one challenge with the fabrication of bulk amorphous alloy parts is partial crystallization of the parts due to either slow cooling or impurities in the raw alloy material. As a high degree of amorphicity (and, conversely, a low degree of crystallinity) is desirable in BMG parts, there is a need to develop methods for casting BMG parts having controlled amount of amorphicity.

Figure 1:
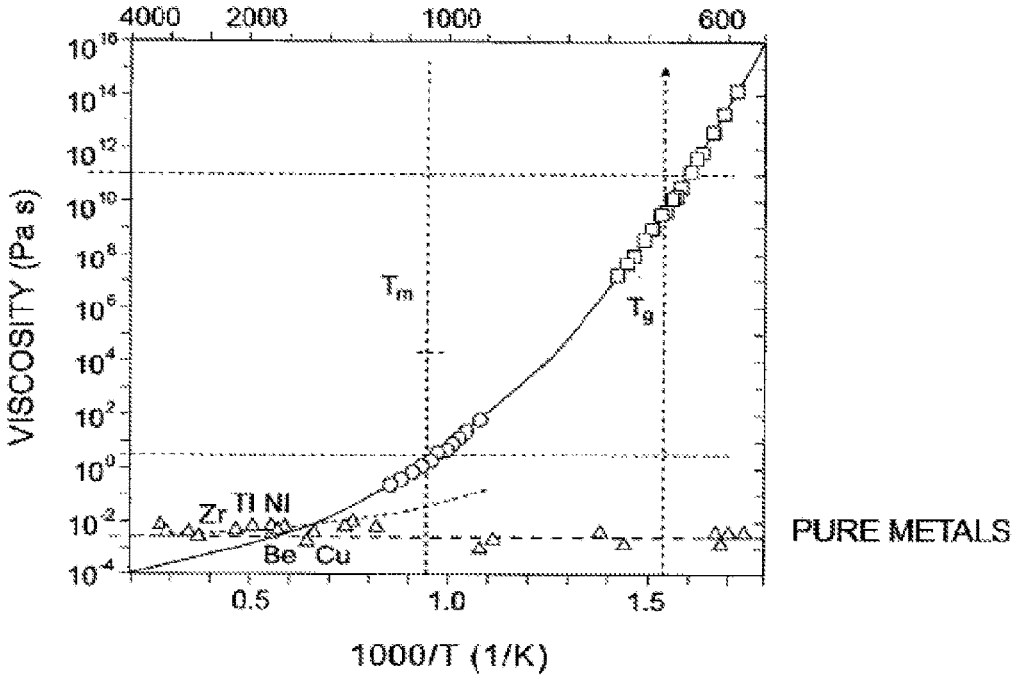
FIG. 1 provides a temperature-viscosity diagram of an exemplary bulk solidifying amorphous alloy.

FIG. 1 (obtained from U.S. Pat. No. 7,575,040) shows a viscosity-temperature graph of an exemplary bulk solidifying amorphous alloy, from the VIT-001 series of Zr—Ti—Ni—Cu—Be family manufactured by Liquidmetal Technology. It should be noted that there is no clear liquid/solid transformation for a bulk solidifying amorphous metal during the formation of an amorphous solid. The molten alloy becomes more and more viscous with increasing undercooling until it approaches solid form around the glass transition temperature. Accordingly, the temperature of solidification front for bulk solidifying amorphous alloys can be around glass transition temperature, where the alloy will practically act as a solid for the purposes of pulling out the quenched amorphous sheet product.

Figure 2:
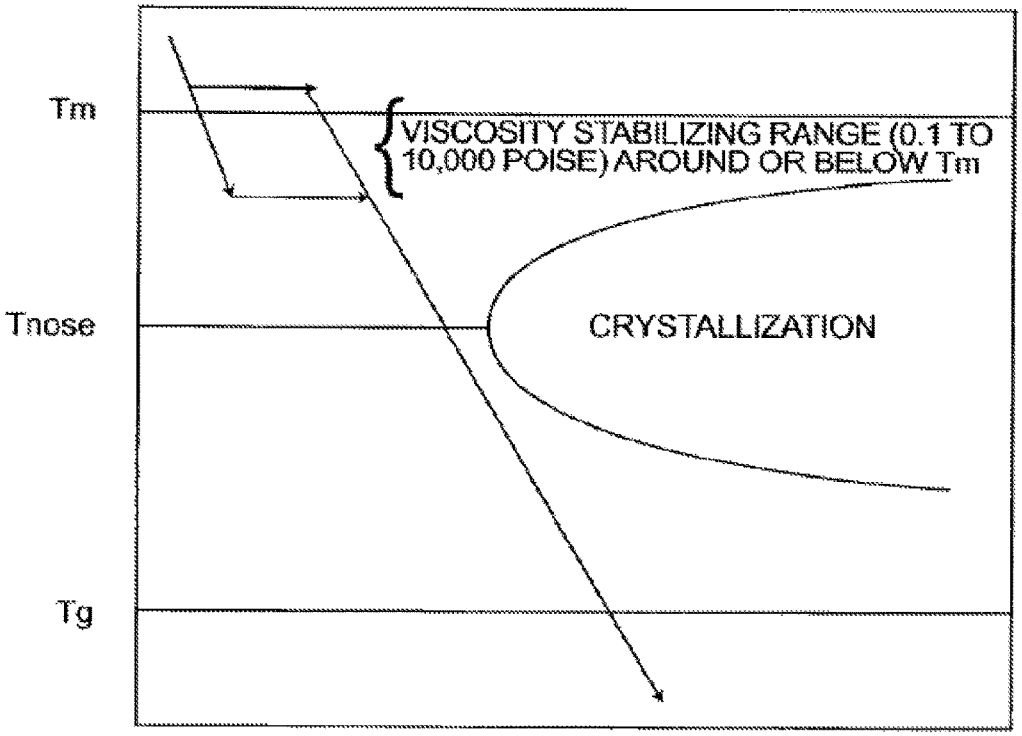
FIG. 2 provides a schematic of a time-temperature-transformation (TTT) diagram for an exemplary bulk solidifying amorphous alloy.

FIG. 2 (obtained from U.S. Pat. No. 7,575,040) shows the time-temperature-transformation (TTT) cooling curve of an exemplary bulk solidifying amorphous alloy, or TTT diagram. Bulk-solidifying amorphous metals do not experience a liquid/solid crystallization transformation upon cooling, as with conventional metals. Instead, the highly fluid, non crystalline form of the metal found at high temperatures (near a "melting temperature" Tm) becomes more viscous as the temperature is reduced (near to the glass transition temperature Tg), eventually taking on the outward physical properties of a conventional solid.

Even though there is no liquid/crystallization transformation for a bulk solidifying amorphous metal, a "melting temperature" Tm may be defined as the thermodynamic liquidus temperature of the corresponding crystalline phase. Under this regime, the viscosity of bulk-solidifying amorphous alloys at the melting temperature could lie in the range of about 0.1 poise to about 10,000 poise, and even sometimes under 0.01 poise. A lower viscosity at the "melting temperature" would provide faster and complete filling of intricate portions of the shell/mold with a bulk solidifying amorphous metal for forming the BMG parts. Furthermore, the cooling rate of the molten metal to form a BMG part has to such that the time-temperature profile during cooling does not traverse through the nose-shaped region bounding the crystallized region in the TTT diagram of FIG. 2. In FIG. 2, Tnose is the critical crystallization temperature Tx where crystallization is most rapid and occurs in the shortest time scale.

The supercooled liquid region, the temperature region between Tg and Tx is a manifestation of the extraordinary stability against crystallization of bulk solidification alloys. In this temperature region the bulk solidifying alloy can exist as a high viscous liquid. The viscosity of the bulk solidifying alloy in the supercooled liquid region can vary between $10^{12}$ Pa s at the glass transition temperature down to $10^{5}$ Pa s at the crystallization temperature, the high temperature limit of the supercooled liquid region. Liquids with such viscosities can undergo substantial plastic strain under an applied pressure. The embodiments herein make use of the large plastic formability in the supercooled liquid region as a forming and separating method.

One needs to clarify something about Tx. Technically, the nose-shaped curve shown in the TTT diagram describes Tx as a function of temperature and time. Thus, regardless of the trajectory that one takes while heating or cooling a metal alloy, when one hits the TTT curve, one has reached Tx. In FIG. 2, Tx is shown as a dashed line as Tx can vary from close to Tm to close to Tg.

The schematic TTT diagram of FIG. 2 shows processing methods of die casting from at or above Tm to below Tg without the time-temperature trajectory (shown as (1) as an example trajectory) hitting the TTT curve. During die casting, the forming takes place substantially simultaneously with fast cooling to avoid the trajectory hitting the TTT curve. The processing methods for superplastic forming (SPF) from at or below Tg to below Tm without the time-temperature trajectory (shown as (2), (3) and (4) as example trajectories) hitting the TTT curve. In SPF, the amorphous BMG is reheated into the supercooled liquid region where the available processing window could be much larger than die casting, resulting in better controllability of the process. The SPF process does not require fast cooling to avoid crystallization during cooling. Also, as shown by example trajectories (2), (3) and (4), the SPF can be carried out with the highest temperature during SPF being above Tnose or below Tnose, up to about Tm. If one heats up a piece of amorphous alloy but manages to avoid hitting the TTT curve, you have heated "between Tg and Tm", but one would have not reached Tx.

Typical differential scanning calorimeter (DSC) heating curves of bulk-solidifying amorphous alloys taken at a heating rate of 20 C/min describe, for the most part, a particular trajectory across the TTT data where one would likely see a Tg at a certain temperature, a Tx when the DSC heating ramp crosses the TTT crystallization onset, and eventually melting peaks when the same trajectory crosses the temperature range for melting. If one heats a bulk-solidifying amorphous alloy at a rapid heating rate as shown by the ramp up portion of trajectories (2), (3) and (4) in FIG. 2, then one could avoid the TTT curve entirely, and the DSC data would show a glass transition but no Tx upon heating. Another way to think about it is trajectories (2), (3) and (4) can fall anywhere in temperature between the nose of the TTT curve (and even above it) and the Tg line, as long as it does not hit the crystallization curve. That just means that the horizontal plateau in trajectories might get much shorter as one increases the processing temperature.

Phase

The term "phase" herein can refer to one that can be found in a thermodynamic phase diagram. A phase is a region of space (e.g., a thermodynamic system) throughout which all physical properties of a material are essentially uniform. Examples of physical properties include density, index of refraction, chemical composition and lattice periodicity. A simple description of a phase is a region of material that is chemically uniform, physically distinct, and/or mechanically separable. For example, in a system consisting of ice and water in a glass jar, the ice cubes are one phase, the water is a second phase, and the humid air over the water is a third phase. The glass of the jar is another separate phase. A phase can refer to a solid solution, which can be a binary, tertiary, quaternary, or more, solution, or a compound, such as an intermetallic compound. As another example, an amorphous phase is distinct from a crystalline phase.

Metal, Transition Metal, and Non-Metal

The term "metal" refers to an electropositive chemical element. The term "element" in this Specification refers generally to an element that can be found in a Periodic Table. Physically, a metal atom in the ground state contains a partially filled band with an empty state close to an occupied state. The term "transition metal" is any of the metallic elements within Groups 3 to 12 in the Periodic Table that have an incomplete inner electron shell and that serve as transitional links between the most and the least electropositive in a series of elements. Transition metals are characterized by multiple valences, colored compounds, and the ability to form stable complex ions. The term "nonmetal" refers to a chemical element that does not have the capacity to lose electrons and form a positive ion.

Depending on the application, any suitable nonmetal elements, or their combinations, can be used. The alloy (or "alloy composition") can comprise multiple nonmetal elements, such as at least two, at least three, at least four, or more, nonmetal elements. A nonmetal element can be any element that is found in Groups 13-17 in the Periodic Table. For example, a nonmetal element can be any one of F, Cl, Br, I, At, O, S, Se, Te, Po, N, P, As, Sb, Bi, C, Si, Ge, Sn, Pb, and B. Occasionally, a nonmetal element can also refer to certain metalloids (e.g., B, Si, Ge, As, Sb, Te, and Po) in Groups 13-17. In one embodiment, the nonmetal elements can include B, Si, C, P, or combinations thereof. Accordingly, for example, the alloy can comprise a boride, a carbide, or both.

A transition metal element can be any of scandium, titanium, vanadium, chromium, manganese, iron, cobalt, nickel, copper, zinc, yttrium, zirconium, niobium, molybdenum, technetium, ruthenium, rhodium, palladium, silver, cadmium, hafnium, tantalum, tungsten, rhenium, osmium, iridium, platinum, gold, mercury, rutherfordium, dubnium, seaborgium, bohrium, hassium, meitnerium, ununnilium, unununium, and ununbium. In one embodiment, a BMG containing a transition metal element can have at least one of Sc, Y, La, Ac, Ti, Zr, Hf, V, Nb, Ta, Cr, Mo, W, Mn, Tc, Re, Fe, Ru, Os, Co, Rh, Ir, Ni, Pd, Pt, Cu, Ag, Au, Zn, Cd, and Hg. Depending on the application, any suitable transitional metal elements, or their combinations, can be used. The alloy composition can comprise multiple transitional metal elements, such as at least two, at least three, at least four, or more, transitional metal elements.

The presently described alloy or alloy "sample" or "specimen" alloy can have any shape or size. For example, the alloy can have a shape of a particulate, which can have a shape such as spherical, ellipsoid, wire-like, rod-like, sheet-like, flake-like, or an irregular shape. The particulate can have any size. For example, it can have an average diameter of between about 1 micron and about 100 microns, such as between about 5 microns and about 80 microns, such as between about 10 microns and about 60 microns, such as between about 15 microns and about 50 microns, such as between about 15 microns and about 45 microns, such as between about 20 microns and about 40 microns, such as between about 25 microns and about 35 microns. For example, in one embodiment, the average diameter of the particulate is between about 25 microns and about 44 microns. In some embodiments, smaller particulates, such as those in the nanometer range, or larger particulates, such as those bigger than 100 microns, can be used.

The alloy sample or specimen can also be of a much larger dimension. For example, it can be a bulk structural component, such as an ingot, housing/casing of an electronic device or even a portion of a structural component that has dimensions in the millimeter, centimeter, or meter range.

Solid Solution

The term "solid solution" refers to a solid form of a solution. The term "solution" refers to a mixture of two or more substances, which may be solids, liquids, gases, or a combination of these. The mixture can be homogeneous or heterogeneous. The term "mixture" is a composition of two or more substances that are combined with each other and are generally capable of being separated. Generally, the two or more substances are not chemically combined with each other.

Alloy

In some embodiments, the alloy composition described herein can be fully alloyed. In one embodiment, an "alloy" refers to a homogeneous mixture or solid solution of two or more metals, the atoms of one replacing or occupying interstitial positions between the atoms of the other; for example, brass is an alloy of zinc and copper. An alloy, in contrast to a composite, can refer to a partial or complete solid solution of one or more elements in a metal matrix, such as one or more compounds in a metallic matrix. The term alloy herein can refer to both a complete solid solution alloy that can give single solid phase microstructure and a partial solution that can give two or more phases. An alloy composition described herein can refer to one comprising an alloy or one comprising an alloy-containing composite.

Thus, a fully alloyed alloy can have a homogenous distribution of the constituents, be it a solid solution phase, a compound phase, or both. The term "fully alloyed" used herein can account for minor variations within the error tolerance. For example, it can refer to at least 90% alloyed, such as at least 95% alloyed, such as at least 99% alloyed, such as at least 99.5% alloyed, such as at least 99.9% alloyed. The percentage herein can refer to either volume percent or weight percentage, depending on the context. These percentages can be balanced by impurities, which can be in terms of composition or phases that are not a part of the alloy.

Amorphous or Non-Crystalline Solid

An "amorphous" or "non-crystalline solid" is a solid that lacks lattice periodicity, which is characteristic of a crystal. As used herein, an "amorphous solid" includes "glass" which is an amorphous solid that softens and transforms into a liquid-like state upon heating through the glass transition. Generally, amorphous materials lack the long-range order characteristic of a crystal, though they can possess some short-range order at the atomic length scale due to the nature of chemical bonding. The distinction between amorphous solids and crystalline solids can be made based on lattice periodicity as determined by structural characterization techniques such as x-ray diffraction and transmission electron microscopy.

The terms "order" and "disorder" designate the presence or absence of some symmetry or correlation in a manyparticle system. The terms "long-range order" and "short-range order" distinguish order in materials based on length scales.

The strictest form of order in a solid is lattice periodicity: a certain pattern (the arrangement of atoms in a unit cell) is repeated again and again to form a translationally invariant tiling of space. This is the defining property of a crystal. Possible symmetries have been classified in 14 Bravais lattices and 230 space groups.

Lattice periodicity implies long-range order. If only one unit cell is known, then by virtue of the translational symmetry it is possible to accurately predict all atomic positions at arbitrary distances. The converse is generally true, except, for example, in quasi-crystals that have perfectly deterministic tilings but do not possess lattice periodicity.

Long-range order characterizes physical systems in which remote portions of the same sample exhibit correlated behavior. This can be expressed as a correlation function, namely the spin-spin correlation function: $G(x,x')=\langle s(x),s(x')\rangle$.

In the above function, s is the spin quantum number and x is the distance function within the particular system. This function is equal to unity when $x=x'$ and decreases as the distance $|x-x'|$ increases. Typically, it decays exponentially to zero at large distances, and the system is considered to be disordered. If, however, the correlation function decays to a constant value at large $|x-x'|$, then the system can be said to possess long-range order. If it decays to zero as a power of the distance, then it can be called quasi-long-range order. Note that what constitutes a large value of $|x-x'|$ is relative.

A system can be said to present quenched disorder when some parameters defining its behavior are random variables that do not evolve with time (i.e., they are quenched or frozen)—e.g., spin glasses. It is opposite to annealed disorder, where the random variables are allowed to evolve themselves. Embodiments herein include systems comprising quenched disorder.

The alloy described herein can be crystalline, partially crystalline, amorphous, or substantially amorphous. For example, the alloy sample/specimen can include at least some crystallinity, with grains/crystals having sizes in the nanometer and/or micrometer ranges. Alternatively, the alloy can be substantially amorphous, such as fully amorphous. In one embodiment, the alloy composition is at least substantially not amorphous, such as being substantially crystalline, such as being entirely crystalline.

In one embodiment, the presence of a crystal or a plurality of crystals in an otherwise amorphous alloy can be construed as a "crystalline phase" therein. The degree of crystallinity (or "crystallinity" for short in some embodiments) of an alloy can refer to the amount of the crystalline phase present in the alloy. The degree can refer to, for example, a fraction of crystals present in the alloy. The fraction can refer to volume fraction or weight fraction, depending on the context. A measure of how "amorphous" an amorphous alloy is can be amorphicity. Amorphicity can be measured in terms of a degree of crystallinity. For example, in one embodiment, an alloy having a low degree of crystallinity can be said to have a high degree of amorphicity. In one embodiment, for example, an alloy having 60 vol % crystalline phase can have a 40 vol % amorphous phase.

Amorphous Alloy or Amorphous Metal

An "amorphous alloy" is an alloy having an amorphous content of more than 50% by volume, preferably more than 90% by volume of amorphous content, more preferably more than 95% by volume of amorphous content, and most preferably more than 99% to almost 100% by volume of amorphous content. Note that, as described above, an alloy high in amorphicity is equivalently low in degree of crystallinity. An "amorphous metal" is an amorphous metal material with a disordered atomic-scale structure. In contrast to most metals, which are crystalline and therefore have a highly ordered arrangement of atoms, amorphous alloys are non-crystalline. Materials in which such a disordered structure is produced directly from the liquid state during cooling are sometimes referred to as "glasses." Accordingly, amorphous metals are commonly referred to as "metallic glasses" or "glassy metals." In one embodiment, a bulk metallic glass ("BMG") can refer to an alloy, of which the microstructure is at least partially amorphous. However, there are several ways besides extremely rapid cooling to produce amorphous metals, including physical vapor deposition, solid-state reaction, ion irradiation, melt spinning, and mechanical alloying. Amorphous alloys can be a single class of materials, regardless of how they are prepared.

Amorphous metals can be produced through a variety of quick-cooling methods. For instance, amorphous metals can be produced by sputtering molten metal onto a spinning metal disk. The rapid cooling, on the order of millions of degrees a second, can be too fast for crystals to form, and the material is thus "locked in" a glassy state. Also, amorphous metals/alloys can be produced with critical cooling rates low enough to allow formation of amorphous structures in thick layers—e.g., bulk metallic glasses.

The terms "bulk metallic glass" ("BMG"), bulk amorphous alloy ("BAA"), and bulk solidifying amorphous alloy are used interchangeably herein. They refer to amorphous alloys having the smallest dimension at least in the millimeter range. For example, the dimension can be at least about 0.5 mm, such as at least about 1 mm, such as at least about 2 mm, such as at least about 4 mm, such as at least about 5 mm, such as at least about 6 mm, such as at least about 8 mm, such as at least about 10 mm, such as at least about 12 mm. Depending on the geometry, the dimension can refer to the diameter, radius, thickness, width, length, etc. A BMG can also be a metallic glass having at least one dimension in the centimeter range, such as at least about 1.0 cm, such as at least about 2.0 cm, such as at least about 5.0 cm, such as at least about 10.0 cm. In some embodiments, a BMG can have at least one dimension at least in the meter range. A BMG can take any of the shapes or forms described above, as related to a metallic glass. Accordingly, a BMG described herein in some embodiments can be different from a thin film made by a conventional deposition technique in one important aspect—the former can be of a much larger dimension than the latter.

Amorphous metals can be an alloy rather than a pure metal. The alloys may contain atoms of significantly different sizes, leading to low free volume (and therefore having viscosity up to orders of magnitude higher than other metals and alloys) in a molten state. The viscosity prevents the atoms from moving enough to form an ordered lattice. The material structure may result in low shrinkage during cooling and resistance to plastic deformation. The absence of grain boundaries, the weak spots of crystalline materials in some cases, may, for example, lead to better resistance to wear and corrosion. In one embodiment, amorphous metals, while technically glasses, may also be much tougher and less brittle than oxide glasses and ceramics.

Thermal conductivity of amorphous materials may be lower than that of their crystalline counterparts. To achieve formation of an amorphous structure even during slower cooling, the alloy may be made of three or more components, leading to complex crystal units with higher potential energy and lower probability of formation. The formation of amorphous alloy can depend on several factors: the composition of the components of the alloy; the atomic radius of the components (preferably with a significant difference of over 12% to achieve high packing density and low free volume); and the negative heat of mixing the combination of components, inhibiting crystal nucleation and prolonging the time the molten metal stays in a supercooled state. However, as the formation of an amorphous alloy is based on many different variables, it can be difficult to make a prior determination of whether an alloy composition would form an amorphous alloy.

Amorphous alloys, for example, of boron, silicon, phosphorus, and other glass formers with magnetic metals (iron, cobalt, nickel) may be magnetic, with low coercivity and high electrical resistance. The high resistance leads to low losses by eddy currents when subjected to alternating magnetic fields, a property useful, for example, as transformer magnetic cores.

Amorphous alloys may have a variety of potentially useful properties. In particular, they tend to be stronger than crystalline alloys of similar chemical composition, and they can sustain larger reversible ("elastic") deformations than crystalline alloys. Amorphous metals derive their strength directly from their non-crystalline structure, which can have none of the defects (such as dislocations) that limit the strength of crystalline alloys. For example, one modern amorphous metal, known as Vitreloy™, has a tensile strength that is almost twice that of high-grade titanium. In some embodiments, metallic glasses at room temperature are not ductile and tend to fail suddenly when loaded in tension, which limits the material applicability in reliability-critical applications, as the impending failure is not evident. Therefore, to overcome this challenge, metal matrix composite materials having a metallic glass matrix containing dendritic particles or fibers of a ductile crystalline metal can be used. Alternatively, a BMG low in element(s) that tend to cause embitterment (e.g., Ni) can be used. For example, a Ni-free BMG can be used to improve the ductility of the BMG.

Another useful property of bulk amorphous alloys is that they can be true glasses; in other words, they can soften and flow upon heating. This can allow for easy processing, such as by injection molding, in much the same way as polymers. As a result, amorphous alloys can be used for making sports equipment, medical devices, electronic components and equipment, and thin films. Thin films of amorphous metals can be deposited as protective coatings via a high velocity oxygen fuel technique.

A material can have an amorphous phase, a crystalline phase, or both. The amorphous and crystalline phases can have the same chemical composition and differ only in the microstructure—i.e., one amorphous and the other crystalline. Microstructure in one embodiment refers to the structure of a material as revealed by a microscope at 25× magnification or higher. Alternatively, the two phases can have different chemical compositions and microstructures. For example, a composition can be partially amorphous, substantially amorphous, or completely amorphous.

As described above, the degree of amorphicity (and conversely the degree of crystallinity) can be measured by fraction of crystals present in the alloy. The degree can refer to volume fraction of weight fraction of the crystalline phase present in the alloy. A partially amorphous composition can refer to a composition of at least about 5 vol % of which is of an amorphous phase, such as at least about 10 vol %, such as at least about 20 vol %, such as at least about 40 vol %, such as at least about 60 vol %, such as at least about 80 vol %, such as at least about 90 vol %. The terms "substantially" and "about" have been defined elsewhere in this application. Accordingly, a composition that is at least substantially amorphous can refer to one of which at least about 90 vol % is amorphous, such as at least about 95 vol %, such as at least about 98 vol %, such as at least about 99 vol %, such as at least about 99.5 vol %, such as at least about 99.8 vol %, such as at least about 99.9 vol %. In one embodiment, a substantially amorphous composition can have some incidental, insignificant amount of crystalline phase present therein.

In one embodiment, an amorphous alloy composition can be homogeneous with respect to the amorphous phase. A substance that is uniform in composition is homogeneous. This is in contrast to a substance that is heterogeneous. The term "composition" refers to the chemical composition and/or microstructure in the substance. A substance is homogeneous when a volume of the substance is divided in half and both halves have substantially the same composition. For example, a particulate suspension is homogeneous when a volume of the particulate suspension is divided in half and both halves have substantially the same volume of particles. However, it might be possible to see the individual particles under a microscope. Another example of a homogeneous substance is air where different ingredients therein are equally suspended, though the particles, gases and liquids in air can be analyzed separately or separated from air.

A composition that is homogeneous with respect to an amorphous alloy can refer to one having an amorphous phase substantially uniformly distributed throughout its microstructure. In other words, the composition macroscopically comprises a substantially uniformly distributed amorphous alloy throughout the composition. In an alternative embodiment, the composition can be of a composite, having an amorphous phase having therein a non-amorphous phase. The non-amorphous phase can be a crystal or a plurality of crystals. The crystals can be in the form of particulates of any shape, such as spherical, ellipsoid, wire-like, rod-like, sheet-like, flake-like, or an irregular shape. In one embodiment, it can have a dendritic form. For example, an at least partially amorphous composite composition can have a crystalline phase in the shape of dendrites dispersed in an amorphous phase matrix; the dispersion can be uniform or non-uniform, and the amorphous phase and the crystalline phase can have the same or a different chemical composition. In one embodiment, they have substantially the same chemical composition. In another embodiment, the crystalline phase can be more ductile than the BMG phase.

The methods described herein can be applicable to any type of amorphous alloy. Similarly, the amorphous alloy described herein as a constituent of a composition or article can be of any type. The amorphous alloy can comprise the element Zr, Hf, Ti, Cu, Ni, Pt, Pd, Fe, Mg, Au, La, Ag, Al, Mo, Nb, Be, or combinations thereof. Namely, the alloy can include any combination of these elements in its chemical formula or chemical composition. The elements can be present at different weight or volume percentages. For example, an iron "based" alloy can refer to an alloy having a non-insignificant weight percentage of iron present therein, the weight percent can be, for example, at least about 20 wt %, such as at least about 40 wt %, such as at least about 50 wt %, such as at least about 60 wt %, such as at least about 80 wt %. Alternatively, in one embodiment, the above-described percentages can be volume percentages, instead of weight percentages. Accordingly, an amorphous alloy can be zirconium-based, titanium-based, platinum-based, palladium-based, gold-based, silver-based, copper-based, iron-based, nickel-based, aluminum-based, molybdenum-based, and the like. The alloy can also be free of any of the aforementioned elements to suit a particular purpose. For example, in some embodiments, the alloy, or the composition including the alloy, can be substantially free of nickel, aluminum, titanium, beryllium, or combinations thereof. In one embodiment, the alloy or the composite is completely free of nickel, aluminum, titanium, beryllium, or combinations thereof.

For example, the amorphous alloy can have the formula $(Zr, Ti)_a(Ni, Cu, Fe)_b(Be, Al, Si, B)_c$, wherein a, b, and c each represents a weight or atomic percentage. In one embodiment, a is in the range of from 30 to 75, b is in the range of from 5 to 60, and c is in the range of from 0 to 50 in atomic percentages. Alternatively, the amorphous alloy can have the formula $(Zr, Ti)_a(Ni, Cu)_b(Be)_c$, wherein a, b, and c each represents a weight or atomic percentage. In one embodiment, a is in the range of from 40 to 75, b is in the range of from 5 to 50, and c is in the range of from 5 to 50 in atomic percentages. The alloy can also have the formula $(Zr, Ti)_a(Ni, Cu)_b(Be)_c$, wherein a, b, and c each represents a weight or atomic percentage. In one embodiment, a is in the range of from 45 to 65, b is in the range of from 7.5 to 35, and c is in the range of from 10 to 37.5 in atomic percentages. Alternatively, the alloy can have the formula $(Zr)_a(Nb, Ti)_b(Ni, Cu)_c(Al)_d$, wherein a, b, c, and d each represents a weight or atomic percentage. In one embodiment, a is in the range of from 45 to 65, b is in the range of from 0 to 10, c is in the range of from 20 to 40 and d is in the range of from 7.5 to 15 in atomic percentages. One exemplary embodiment of the aforedescribed alloy system is a Zr—Ti—Ni—Cu—Be based amorphous alloy under the trade name Vitreloy™ such as Vitreloy-1 and Vitreloy-101, as fabricated by Liquidmetal Technologies, CA, USA. Some examples of amorphous alloys of the different systems are provided in Table 1 and Table 2.

TABLE 1

| Exemplary amorphous alloy compositions (atomic %) | | | | | | |
|---|---|---|---|---|---|---|
| Alloy | Atm % | Atm % | Atm % | Atm % | Atm % | Atm % |
| 1 | Zr 41.20% | Ti 13.80% | Cu 12.50% | Ni 10.00% | Be 22.50% | |

TABLE 1-continued

| Exemplary amorphous alloy compositions (atomic %) | | | | | | |
|---|---|---|---|---|---|---|
| Alloy | Atm % | Atm % | Atm % | Atm % | Atm % | Atm % |
| 2 | Zr 44.00% | Ti 11.00% | Cu 10.00% | Ni 10.00% | Be 25.00% | |
| 3 | Zr 56.25% | Ti 11.25% | Cu 6.88% | Ni 5.63% | Nb 7.50% | Be 12.50% |
| 4 | Zr 64.75% | Ti 5.60% | Cu 14.90% | Ni 11.15% | Al 2.60% | Be 1.00% |
| 5 | Zr 52.50% | Ti 5.00% | Cu 17.90% | Ni 14.60% | Al 10.00% | |
| 6 | Zr 57.00% | Nb 5.00% | Cu 15.40% | Ni 12.60% | Al 10.00% | |
| 7 | Zr 50.75% | Cu 36.23% | Ni 4.03% | Al 9.00% | | |
| 8 | Zr 46.75% | Ti 8.25% | Cu 7.50% | Ni 10.00% | Be 27.50% | |
| 9 | Zr 21.67% | Ti 43.33% | Ni 7.50% | Be 27.50% | | |
| 10 | Zr 35.00% | Ti 30.00% | Cu 7.50% | Be 27.50% | | |
| 11 | Zr 35.00% | Ti 30.00% | Co 6.00% | Be 29.00% | | |
| 12 | Zr 35.00% | Ti 30.00% | Fe 2.00% | Be 33.00% | | |
| 13 | Au 49.00% | Ag 5.50% | Pd 2.30% | Cu 26.90% | Si 16.30% | |
| 14 | Au 50.90% | Ag 3.00% | Pd 2.30% | Cu 27.80% | Si 16.00% | |
| 15 | Pt 57.50% | Cu 14.70% | Ni 5.30% | P 22.50% | | |
| 16 | Zr 36.60% | Ti 31.40% | Nb 7.00% | Cu 5.90% | Be 19.10% | |
| 17 | Zr 38.30% | Ti 32.90% | Nb 7.30% | Cu 6.20% | Be 15.30% | |
| 18 | Zr 39.60% | Ti 33.90% | Nb 7.60% | Cu 6.40% | Be 12.50% | |
| 19 | Cu 47.00% | Ti 34.00% | Zr 11.00% | Ni 8.00% | | |
| 20 | Zr 55.00% | Co 25.00% | Al 20.00% | | | |

TABLE 2

| Additional exemplary amorphous alloy compositions | | | | | | | | |
|---|---|---|---|---|---|---|---|---|
| Alloy | Atm % | Atm % | Atm % | Atm % | Atm % | Atm % | Atm % | Atm % |
| 1 | Fe 68.00% | Mo 5.00% | Ni 5.00% | Cr 2.00% | P 12.50% | C 5.00% | B 2.50% | |
| 2 | Fe 68.00% | Mo 5.00% | Ni 5.00% | Cr 2.00% | P 11.00% | C 5.00% | B 2.50% | Si 1.50% |
| 3 | Pd 44.48% | Cu 32.35% | Co 4.05% | P 19.11% | | | | |
| 4 | Pd 77.50% | Ag 6.00% | Si 9.00% | P 7.50% | | | | |
| 5 | Pd 79.00% | Ag 3.50% | Si 9.50% | P 6.00% | Ge 2.00% | | | |
| 6 | Pt 74.70% | Cu 1.50% | Ag 0.30% | P 18.0% | B 4.00% | Si 1.50% | | |

Other exemplary ferrous metal-based alloys include compositions such as those disclosed in U.S. Patent Application Publication Nos. 2007/0079907 and 2008/0118387. These compositions include the Fe(Mn, Co, Ni, Cu) (C, Si, B, P, Al) system, wherein the Fe content is from 60 to 75 atomic percentage, the total of (Mn, Co, Ni, Cu) is in the range of from 5 to 25 atomic percentage, and the total of (C, Si, B, P, Al) is in the range of from 8 to 20 atomic percentage, as well as the exemplary composition Fe48Cr15Mo14Y2C15B6. They also include the alloy systems described by Fe—Cr—Mo—(Y,Ln)-C—B, Co—Cr—Mo-Ln-C—B, Fe—Mn—Cr—Mo—(Y,Ln)-C—B, (Fe, Cr, Co)—(Mo,Mn)—(C,B)—Y, Fe—(Co,Ni)—(Zr,Nb,Ta)—(Mo,W)—B, Fe—(Al,Ga)—(P,C,B,Si,Ge), Fe—(Co, Cr,Mo,Ga,Sb)—P—B—C, (Fe, Co)—B—Si—Nb alloys, and Fe—(Cr—Mo)—(C,B)—Tm, where Ln denotes a lanthanide element and Tm denotes a transition metal element. Furthermore, the amorphous alloy can also be one of the exemplary compositions Fe80P12.5C5B2.5, Fe80P11C5B2.5Si1.5, Fe74.5Mo5.5P12.5C5B2.5, Fe74.5Mo5.5P11C5B2.5Si1.5, Fe70Mo5Ni5P12.5C5B2.5, Fe70Mo5Ni5P11C5B2.5Si1.5, Fe68Mo5Ni5Cr2P12.5C5B2.5, and Fe68Mo5Ni5Cr2P11C5B2.5Si1.5, described in U.S. Patent Application Publication No. 2010/0300148.

The amorphous alloys can also be ferrous alloys, such as (Fe, Ni, Co) based alloys. Examples of such compositions are disclosed in U.S. Pat. Nos. 6,325,868; 5,288,344; 5,368,659; 5,618,359; and 5,735,975, Inoue et al., Appl. Phys. Lett., Volume 71, p 464 (1997), Shen et al., Mater. Trans., JIM, Volume 42, p 2136 (2001), and Japanese Patent Application No. 200126277 (Pub. No. 2001303218 A). One exemplary composition is $Fe_{72}Al_5Ga_2P_{11}C_6B_4$. Another example is $Fe_{72}Al_7Zr_{10}Mo_5W_2B_{15}$. Another iron-based alloy system that can be used in the coating herein is disclosed in U.S. Patent Application Publication No. 2010/0084052, wherein the amorphous metal contains, for example, manganese (1 to 3 atomic %), yttrium (0.1 to 10 atomic %), and silicon (0.3 to 3.1 atomic %) in the range of composition given in parentheses; and that contains the following elements in the specified range of composition given in parentheses: chromium (15 to 20 atomic %), molybdenum (2 to 15 atomic %), tungsten (1 to 3 atomic %), boron (5 to 16 atomic %), carbon (3 to 16 atomic %), and the balance iron.

The aforedescribed amorphous alloy systems can further include additional elements, such as additional transition metal elements, including Nb, Cr, V, and Co. The additional elements can be present at less than or equal to about 30 wt %, such as less than or equal to about 20 wt %, such as less than or equal to about 10 wt %, such as less than or equal to about 5 wt %. In one embodiment, the additional, optional element is at least one of cobalt, manganese, zirconium, tantalum, niobium, tungsten, yttrium, titanium, vanadium and hafnium to form carbides and further improve wear and corrosion resistance. Further optional elements may include phosphorous, germanium and arsenic, totaling up to about 2%, and preferably less than 1%, to reduce melting point. Otherwise incidental impurities should be less than about 2% and preferably 0.5%.

In some embodiments, a composition having an amorphous alloy can include a small amount of impurities. The impurity elements can be intentionally added to modify the properties of the composition, such as improving the mechanical properties (e.g., hardness, strength, fracture mechanism, etc.) and/or improving the corrosion resistance. Alternatively, the impurities can be present as inevitable, incidental impurities, such as those obtained as a byproduct of processing and manufacturing. The impurities can be less than or equal to about 10 wt %, such as about 5 wt %, such as about 2 wt %, such as about 1 wt %, such as about 0.5 wt %, such as about 0.1 wt %. In some embodiments, these percentages can be volume percentages instead of weight percentages. In one embodiment, the alloy sample/composition consists essentially of the amorphous alloy (with only a small incidental amount of impurities). In another embodiment, the composition includes the amorphous alloy (with no observable trace of impurities).

In one embodiment, the final parts exceeded the critical casting thickness of the bulk solidifying amorphous alloys.

In embodiments herein, the existence of a supercooled liquid region in which the bulk-solidifying amorphous alloy can exist as a high viscous liquid allows for superplastic forming. Large plastic deformations can be obtained. The ability to undergo large plastic deformation in the supercooled liquid region is used for the forming and/or cutting process. As oppose to solids, the liquid bulk solidifying alloy deforms locally which drastically lowers the required energy for cutting and forming. The ease of cutting and forming depends on the temperature of the alloy, the mold, and the cutting tool. As higher is the temperature, the lower is the viscosity, and consequently easier is the cutting and forming.

Embodiments herein can utilize a thermoplastic-forming process with amorphous alloys carried out between Tg and Tx, for example. Herein, Tx and Tg are determined from standard DSC measurements at typical heating rates (e.g. 20° C./min) as the onset of crystallization temperature and the onset of glass transition temperature.

The amorphous alloy components can have the critical casting thickness and the final part can have thickness that is thicker than the critical casting thickness. Moreover, the time and temperature of the heating and shaping operation is selected such that the elastic strain limit of the amorphous alloy could be substantially preserved to be not less than 1.0%, and preferably not being less than 1.5%. In the context of the embodiments herein, temperatures around glass transition means the forming temperatures can be below glass transition, at or around glass transition, and above glass transition temperature, but preferably at temperatures below the crystallization temperature $T_x$. The cooling step is carried out at rates similar to the heating rates at the heating step, and preferably at rates greater than the heating rates at the heating step. The cooling step is also achieved preferably while the forming and shaping loads are still maintained.

Electronic Devices

The embodiments herein can be valuable in the fabrication of electronic devices using a BMG. An electronic device herein can refer to any electronic device known in the art. For example, it can be a telephone, such as a cell phone, and a land-line phone, or any communication device, such as a smart phone, including, for example an iPhone™, and an electronic email sending/receiving device. It can be a part of a display, such as a digital display, a TV monitor, an electronic-book reader, a portable web-browser (e.g., iPad™), and a computer monitor. It can also be an entertainment device, including a portable DVD player, conventional DVD player, Blu-Ray disk player, video game console, music player, such as a portable music player (e.g., iPod™), etc. It can also be a part of a device that provides control, such as controlling the streaming of images, videos, sounds (e.g., Apple TV™), or it can be a remote control for an electronic device. It can be a part of a computer or its accessories, such as the hard drive tower housing or casing, laptop housing, laptop keyboard, laptop track pad, desktop keyboard, mouse, and speaker. The article can also be applied to a device such as a watch or a clock.

The methods, techniques, and devices illustrated herein are not intended to be limited to the illustrated embodiments.

As disclosed herein, an apparatus or a system (or a device or a machine) is configured to perform melting of and injection molding of material(s) (such as amorphous alloys). The system is configured to process such materials or alloys by melting at higher melting temperatures before injecting the molten material into a mold for molding. As further described below, parts of the apparatus are positioned in-line with each other. In accordance with some embodiments, parts of the apparatus (or access thereto) are aligned on a horizontal axis.

When molding parts using amorphous alloy materials, the quality of the part can be diminished when it is formed and molded because of amorphous alloy material not being completely melted during the processing cycle. Specifically, when using amorphous alloy materials in an injection molding machine, if the material is not uniformly heated to a high temperature and/or if the uniformly heated high temperature of the molten material is not maintained before being molded, the material (in its molten state) can form crystals therein or a skull during melting and/or moving material into a mold in the machine. "Skull," as referred to throughout this disclosure, is defined as crystallized amorphous alloy, or crystals. Skull can be formed in amorphous alloy material when part of the meltable material is reduced in temperature during the processing cycle, or if part or a layer of the material does not melt or is not heated to high enough temperature. It may include a layer, a slush, or a slurry of crystals in the molten material. The skull can be formed in regions that are in immediate contact with a cold(er) surface. For example, if amorphous alloy is melted in a vessel or boat-style crucible (e.g., made of copper) with temperature control or cooling capabilities, some of the material that is in contact with the vessel near the temperature cooling areas may not reach a high enough temperature to be fully molten, thus forming a skull layer in the molten material near the surface in contact with those cooler parts of the vessel (e.g., at a bottom or sides of the molten material). As another example, when molten amorphous alloy material is moved for injection from the melt zone and into the mold (e.g., through a transfer sleeve), some of the molten material can cool and form skull. In some cases, such as when moved through transfer sleeve, the production of skull layer may be inadvertently induced, because not all parts of the injection molding system or machine are temperature controlled and/or heated. For example, the herein described transfer sleeve (30) may be a cold sleeve, e.g., not heated, or provided at room temperature.

The skull can result in an adverse effect to the injection molding process. For example, the skull of an amorphous alloy (or BMG) may result in crystalline structures. Introducing crystalline materials into an injection molded part can, for example, decrease the strength of a part, weaken quality of a part, and cause unattractive speckles on the surface of the part. Accordingly, this disclosure provides several exemplary methods and systems for minimizing and/or removing skull from amorphous alloys as a result of heat transfer differences within different parts of an injection molding system.

Throughout this disclosure, reference to meltable material, molten material, or material in a molten state as used, melted, and molded in an injection system refers to amorphous alloy material, such as those materials described above in detail.

Also, as understood throughout, a "cookie" is remaining material (e.g., slug) that comes out of the mold with the molded part and/or remains in the transfer sleeve once molding is completed (material which can initially enter the mold but may be pushed or flow out during molding). In some cases, it may need to be removed (e.g., cut away) from the molded piece, or machine techniques may be applied to the ejected molded piece before the part is finalized.

The following embodiments are for illustrative purposes only and are not meant to be limiting.

Figure 3:
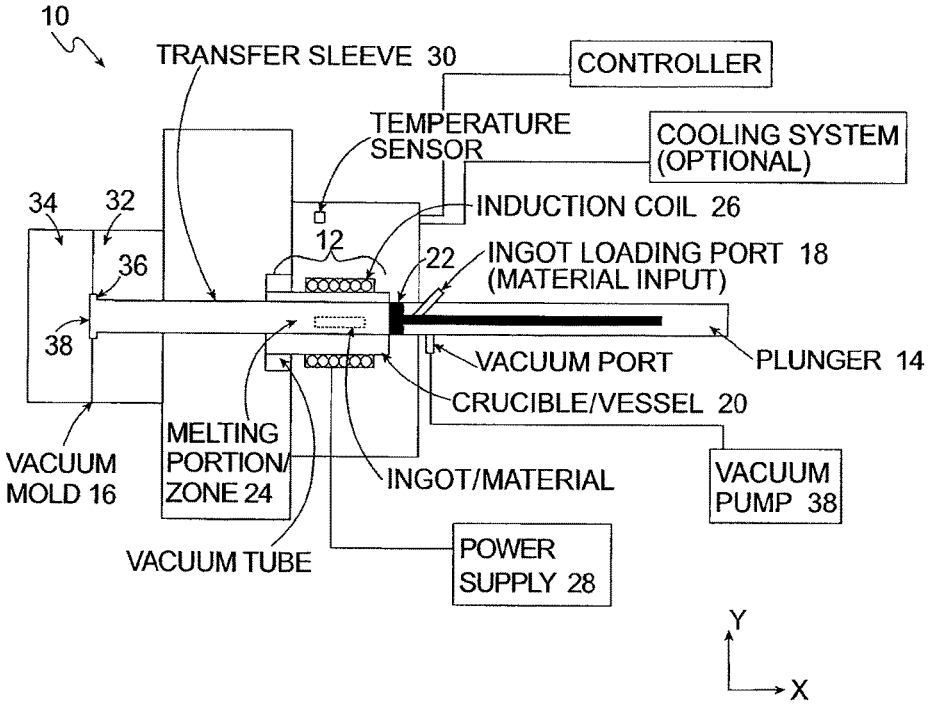
FIG. 3 illustrates an injection molding system in accordance with an embodiment for implementing one or more skull trapping systems and methods as disclosed herein.

FIG. 3 illustrates a schematic diagram of such an exemplary system. More specifically, FIG. 3 illustrates an injection molding apparatus or system 10. In accordance with an embodiment, injection molding system 10 has a melt zone 12 configured to melt meltable material received therein, and at least one plunger rod 14 with a tip 22 configured to move and eject molten material from melt zone 12 and into a mold 16. In an embodiment, at least plunger rod 14 and melt zone 12 are provided in-line and on a horizontal axis (e.g., X axis), such that plunger rod 14 is moved in a horizontal direction (e.g., along the X-axis) substantially through melt zone 12 to move the molten material into mold 16. The mold can be positioned adjacent to the melt zone.

The meltable amorphous alloy material can be received in the melt zone in any number of forms. For example, the meltable material may be provided into melt zone 12 in the form of an ingot (solid state), a semi-solid state, a slurry that is preheated, powder, pellets, etc. In some embodiments, a loading port (such as the illustrated example of an ingot loading port 18) may be provided as part of injection molding system 10. Loading port 18 can be a separate opening or area that is provided within the machine at any number of places. In an embodiment, loading port 18 may be a pathway through one or more parts of the machine (e.g., not separately formed therein). For example, the material (e.g., ingot) may be inserted in a horizontal direction into vessel 20 by plunger 14, or may be inserted in a horizontal direction from the mold side of the injection system 10 (e.g., through mold 16 and/or through a transfer sleeve 30 into vessel 20). In other embodiments, the meltable material can be provided into melt zone 12 in other manners and/or using other devices (e.g., through an opposite end of the injection system).

Melt zone 12 includes a melting mechanism configured to receive meltable material and to hold the material as it is heated to a molten state. The melting mechanism may be in the form of a vessel 20, for example, that has a body for receiving meltable material and configured to melt the material therein. A vessel as used throughout this disclosure is a container made of a material employed for heating substances to high temperatures. For example, in an embodiment, the vessel may be a crucible, such as a boat style crucible, or a skull crucible. In an embodiment, vessel 20 is a cold hearth melting device that is configured to be utilized for meltable material(s) while under a vacuum (e.g., applied by a vacuum device 38 or pump). In one embodiment, described further below, the vessel is a temperature regulated vessel.

Vessel 20 may also have an inlet for inputting material (e.g., feedstock) into a receiving or melting portion 24 of its body. In an embodiment, the body of vessel 20 comprises a substantially U-shaped structure. However, this shape is not meant to be limiting. Vessel 20 can comprise any number of shapes or configurations. The body of the vessel has a length and can extend in a longitudinal and horizontal direction, such that molten material is removed horizontally therefrom using plunger 14. For example, the body may comprise a base with side walls extending vertically therefrom. The material for heating or melting may be received in a melting portion 24 of the vessel. Melting portion 24 is configured to receive meltable material to be melted therein. For example, melting portion 24 has a surface for receiving material. Vessel 20 may receive material (e.g., in the form of an ingot)

in its melting portion 24 using one or more devices of an injection system for delivery (e.g., a loading port, a loading device, and/or a plunger).

The body of vessel 20 may be configured to receive the plunger rod therethrough in a horizontal direction to move the molten material. That is, in an embodiment, the melting mechanism is on the same axis as the plunger rod, and the body can be configured and/or sized to receive at least part of the plunger rod. Thus, plunger rod 14 can be configured to move molten material (after heating/melting) from the vessel and melt zone 12 by moving substantially through vessel 20, and to mold 16. Referencing the illustrated embodiment of system 10 in FIG. 3, for example, plunger rod 14 would move in a horizontal direction from the right towards the left, through vessel 20, moving and pushing the molten material towards and into mold 16.

To heat melt zone 12 and melt the meltable material received in vessel 20, injection system 10 also includes a heat source that is used to heat and melt the meltable material At least melting portion 24 of the vessel, if not substantially the entire body itself, is configured to be heated such that the material received therein is melted. Heating is accomplished using, for example, an induction source 26 positioned within melt zone 12 that is configured to melt the meltable material. In an embodiment, induction source 26 is positioned adjacent vessel 20. For example, induction source 26 may be in the form of a coil positioned in a helical pattern substantially around a length of the vessel body. Accordingly, vessel 20 may be configured to inductively melt a meltable material (e.g., an inserted ingot) within melting portion 24 by supplying power to induction source/coil 26, using a power supply or source 28. Thus, the melt zone 12 can include an induction zone. Induction coil 26 is configured to heat up and melt any material that is contained by vessel 20 without melting and wetting vessel 20. Induction coil 26 emits radiofrequency (RF) waves towards vessel 20. As shown, the body and coil 26 surrounding vessel 20 may be configured to be positioned in a horizontal direction along a horizontal axis (e.g., X axis).

In one embodiment, the vessel 20 is a temperature regulated vessel. Such a vessel may include one or more temperature regulating lines configured to flow a liquid (e.g., water, or other fluid) therein for regulating a temperature of the body of vessel 20 during melting of material received in the vessel (e.g., to force cool the vessel). Such a forced-cool crucible can also be provided on the same axis as the plunger rod. The cooling line(s) can assist in preventing excessive heating and melting of the body of the vessel 20 itself. Cooling line(s) may be connected to a cooling system configured to induce flow of a liquid in the vessel. The cooling line(s) may include one or more inlets and outlets for the liquid or fluid to flow therethrough. The inlets and outlets of the cooling lines may be configured in any number of ways and are not meant to be limited. For example, cooling line(s) may be positioned relative to melting portion 24 such that material thereon is melted and the vessel temperature is regulated (i.e., heat is absorbed, and the vessel is cooled). The number, positioning and/or direction of the cooling line(s) should not be limited. The cooling liquid or fluid may be configured to flow through the cooling line(s) during melting of the meltable material, when induction source 26 is powered.

After the material is melted in the vessel 20, plunger 14 may be used to force the molten material from the vessel 20 and into a mold 16 for molding into an object, a part or a piece. In instances wherein the meltable material is an amorphous alloy, the mold 16 is configured to form a molded bulk amorphous alloy object, part, or piece. Mold 16 has an inlet for receiving molten material therethrough. An output of the vessel 20 and an inlet of the mold 16 can be provided in-line and on a horizontal axis such that plunger rod 14 is moved in a horizontal direction through body of the vessel to eject molten material and into the mold 16 via its inlet.

In some embodiments, the injection molding system 10 comprises a transfer sleeve 30. Transfer sleeve 30 (sometimes referred to as a shot sleeve, a cold sleeve, or an injection sleeve in the art and herein) may be provided between melt zone 12 and mold 16. Transfer sleeve 30 has an opening that is configured to receive and allow transfer of the molten material therethrough and into mold 16 (using plunger 14). Its opening may be provided in a horizontal direction along the horizontal axis (e.g., X axis). The transfer sleeve need not be a cold chamber. In an embodiment, at least plunger rod 14, vessel 20 (e.g., its receiving or melting portion), and opening or path of the transfer sleeve 30 are provided in-line and on a horizontal axis, such that plunger rod 14 can be moved in a horizontal direction through vessel 20 in order to move the molten material into (and subsequently through) the opening of transfer sleeve 30. Molten material is pushed in a horizontal direction through transfer sleeve 30 and into the mold cavity(ies) via its inlet.

As previously noted, systems such as injection molding system 10 that are used to mold materials such as metals or alloys may implement a vacuum when forcing molten material into a mold or die cavity. Injection molding system 10 can further includes at least one vacuum source 38 or pump that is configured to apply vacuum pressure to at least melt zone 12 and mold 16. The vacuum pressure may be applied to at least the parts of the injection molding system 10 used to melt, move or transfer, and mold the material therein. For example, the vessel 20, transfer sleeve 30, and plunger rod 14 may all be under vacuum pressure and/or enclosed in a vacuum chamber.

In an embodiment, mold 16 is a vacuum mold that is an enclosed structure configured to regulate vacuum pressure therein when molding materials. For example, in an embodiment, vacuum mold 16 comprises a first plate 32 (also referred to as an "A" mold or "A" plate), a second plate 34 (also referred to as a "B" mold or "B" plate) positioned adjacently (respectively) with respect to each other. The first plate 32 and second plate 34 generally each have a mold cavity 36 and 38, respectively, associated therewith for molding melted material therebetween. The cavities are configured to mold molten material received therebetween via an injection sleeve or transfer sleeve 30. The mold cavities 36 and 38 may include a part cavity for forming and molding a part therein.

Generally, the first plate 32 may be connected to transfer sleeve 30. In accordance with an embodiment, plunger rod 14 is configured to move molten material from vessel 20, through a transfer sleeve 30, and into mold 16, e.g., the inlet into the cavity(ies) of mold 16 being provided in a first plate 32, and the cavity being between the first and second plates 32 and 34, respectively.

During molding of the material, the at least first and second plates of mold 16 are configured to substantially eliminate exposure of the material (e.g., molten amorphous alloy) therebetween to at least oxygen and nitrogen. Specifically, a vacuum is applied such that atmospheric air is substantially eliminated from within the plates and their cavities. A vacuum pressure is applied to an inside of vacuum mold 16 using at least one vacuum source 38 that is connected via vacuum lines. For example, the vacuum pressure or level on the system can be held between $1\times10^{-1}$ to $1\times10^{-4}$ Torr during the melting and subsequent molding cycle. In another embodiment, the vacuum level is maintained between $1\times10^{-2}$ to about $1\times10^{-4}$ Torr during the melting and molding process. Of course, other pressure levels or ranges may be used, such as $1\times10^{-9}$ Torr to about $1\times10^{-3}$ Torr, and/or $1\times10^{-3}$ Torr to about 0.1 Torr. An ejector mechanism (not shown) is configured to eject molded (amorphous alloy) material (or the molded part) from the mold cavity between the first and second plates 32 and 34 of mold 16. The ejection mechanism is associated with or connected to an actuation mechanism (not shown) that is configured to be actuated in order to eject the molded material or part (e.g., after first and second plates and are moved horizontally and relatively away from each other, after vacuum pressure between at least the plates is released).

In some cases, as noted below, additional machining is performed on the ejected, molded piece before producing a finished, molded part. For example, the cookie and/or extra molded material (e.g., trapped and molded material including skull material) may be removed before the part is finalized.

Any number or types of molds may be employed in the apparatus 10. For example, any number of plates may be provided between and/or adjacent the first and second plates to form the mold. Molds known as "A" series, "B" series, and/or "X" series molds, for example, may be implemented in injection molding system/apparatus 10.

Although cooling lines in vessel 20 can assist in cooling the vessel body, as previously noted, in some cases, they may also induce formation of skull material in the molten amorphous alloy material. Alternatively, even without cooling lines, parts of the molten amorphous alloy material can crystallize into skull material before being molded. For example, the molten material may be cooled during transport from melt zone 12 and to mold 16. Uniform heating of the material to be melted and maintenance of temperature of molten material in such an injection molding apparatus 10 assists in forming a uniform molded part. Molding with skull material decreases its quality and integrity.

Accordingly, this disclosure provides several different concepts to address the need for reducing and/or prevent molding with skull material, by reducing and/or removing skull parts from amorphous alloys as a result of heat transfer differences within different parts of an injection molding system.

Figure 4:
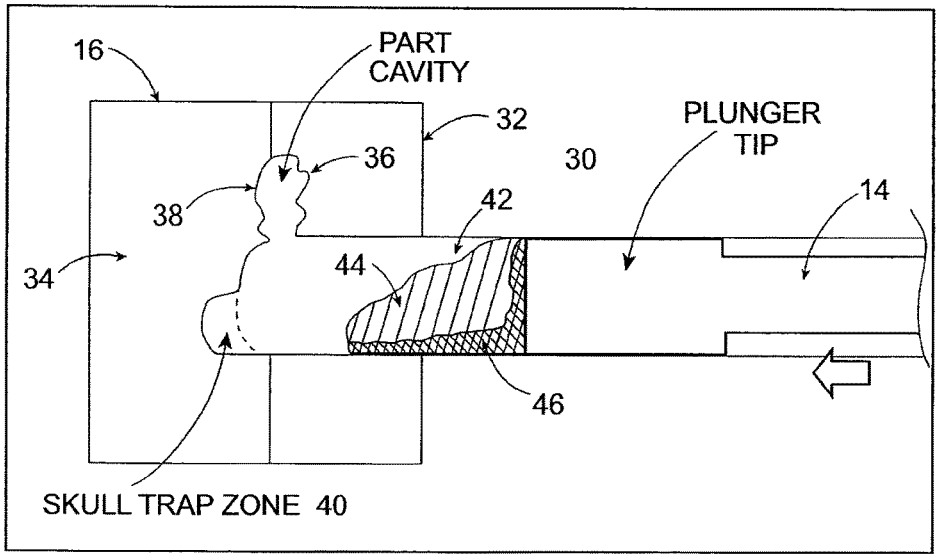
FIG. 4 illustrates a detailed, sectional view of a mold, a transfer sleeve, and melt zone associated with the injection molding system shown in FIG. 3, in accordance with an embodiment.

In accordance with some embodiments, the skull is designed to be mechanically separated in an injection molding system, such as system 10, during the processing cycle, i.e., the processing cycle being at least from a time of melting in melt zone 12 until completion of molding of molten material in mold 16. In an embodiment, an injection molding system includes a cavity therein that is configured to trap skull material from molten material and within the tip so as to substantially reduce an amount of the skull or crystallized material in a finished, molded part. This thereby reduces the probability that the skull material will be pushed into the cavity and become entrained in a molded part (thus increasing quality of the part). For example, as shown in FIG. 4, as plunger tip 22 of plunger rod 14 moves molten material 42 from melt zone 12 and through transfer sleeve 30 towards mold 16, molten material 42 may form a skull 46. That is, molten material 42 may include both the higher temperature molten pool 44 of the material (amorphous alloy) and cooler skull material 46. In order to reduce and/or prevent this skull material 46 from being in the final, molded part, FIG. 4 illustrates one embodiment of a cavity 40 provided in mold 16 that is configured to trap skull material in molten amorphous alloy. More specifically, a skull trap zone 40, cavity, or area is provided within the mold cavity (ies) used to mold a part. Skull trap zone 40 can be an extension of the actual mold used to form the part. In the illustrated embodiment, skull trap zone 40 is provided as an extension of mold cavity 38 in second plate 34 of mold 16. It is designed such that when the molten material 42 is injected in between the first and second plates 32 and 34 and into their respective cavities 36 and 36, the skull material 46 will be substantially forced into the skull trap zone 40, so that much or substantially all of the skull material 46 enters a separate area of the mold 16 that is distinct from the cavity is used to form the part. After the part is formed, the molded part can be ejected, and further machining may be used to finalize the molded part. That is, any material that is injected, molded, and hardened in skull trap zone 40 can be machined off, so that the final part need not include any hardened skull or crystallized material.

In the illustrated embodiment, skull material 46 is shown as being formed near a bottom traveling surface (e.g., pathway in transfer sleeve 30) and near plunger tip 22. This is exemplary. Based on this example, the skull trap zone 40 is configured to be positioned in the mold 16 so that upon injection into the mold 16, skull material 46 is forced therein. However, even though FIG. 4 shows skull trap zone 40 as an extension in the second cavity 38, its location is exemplary only and is not meant to be limiting. For example, the skull trap zone 40 may be provided as part of cavity 36 of first plate 32. Accordingly, it should be understood that the skull trap zone 40 can be positioned in an area in or adjacent mold that is determined to receive a substantial amount of skull material 46 from molten material 42.

In accordance with some other embodiments, the skull 46 is mechanically separated from the molten material 42 before entering the mold. FIGS. 5-8 illustrate alternative examples for separating skull material. Specifically, the skull is mechanically separated from the molten material (alloy) as the molten material is pushed from the melt zone 12 and into mold 16 using tip 22 of plunger rod 14. For example, a cavity may be provided in tip 22 of plunger rod 14. In some embodiments, the cavity in the tip of plunger rod 22 can be provided below a centerline (horizontal, longitudinal line) of plunger rod 14, so that skull material is captured or trapped therein. That is, with skull material 46 forming near a bottom surface and/or end of plunger rod 22 (e.g., as shown in FIG. 4), the cavity can be designed to separate the skull 46 from pool 44 of molten material 42.

Figures 5, 6:
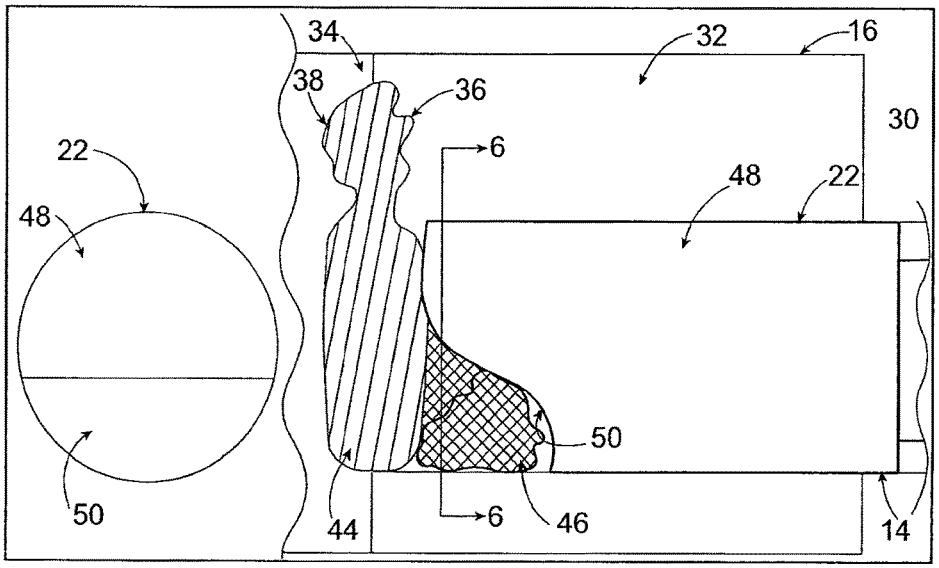
FIGS. 5 and 6 illustrate a detailed, sectional and cross-sectional view taken along line 6-6 in FIG. 5, respectively, of a tip of a plunger and mold associated with the injection molding system shown in FIG. 3, in accordance with another embodiment.
Figure 10:
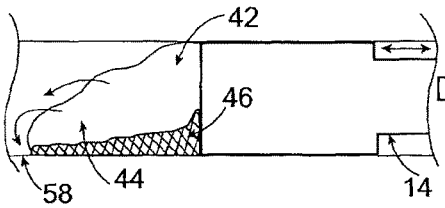
FIGS. 10-12 illustrate a detailed view of using a plunger to induce and provide mixing of molten material as it is moved from a melt zone to a mold in accordance with an embodiment.

FIGS. 5 and 6 illustrate one example of a plunger tip 22 with a body 48 having a cavity 50 provided at its end that is configured to at least move molten material from melt zone 12 to mold 16. For example, cavity 50 may be provided substantially below a centerline of plunger rod 14 and have a rounded configuration. Cavity 50 is configured extend rearwardly from the end of plunger tip 22. Cavity 50 is designed and configured such that much or substantially all of skull material 46 in molten material 42 is trapped in cavity 50 during movement towards mold 16 and/or when the molten material is injected into mold 16, while the higher temperature molten pool 44 of the amorphous alloy material is pushed into mold 16 and molded into a part using cavities 36 and 38. After the part is formed, the molded part can be ejected and further machining may be used to finalize the molded part. That is, any material that is trapped in cavity 50 of plunger body 48 may be hardened and molded with the part. Thus, such material can be machined off, so that the final part need not include any hardened skull or crystallized material.

Figure 18:
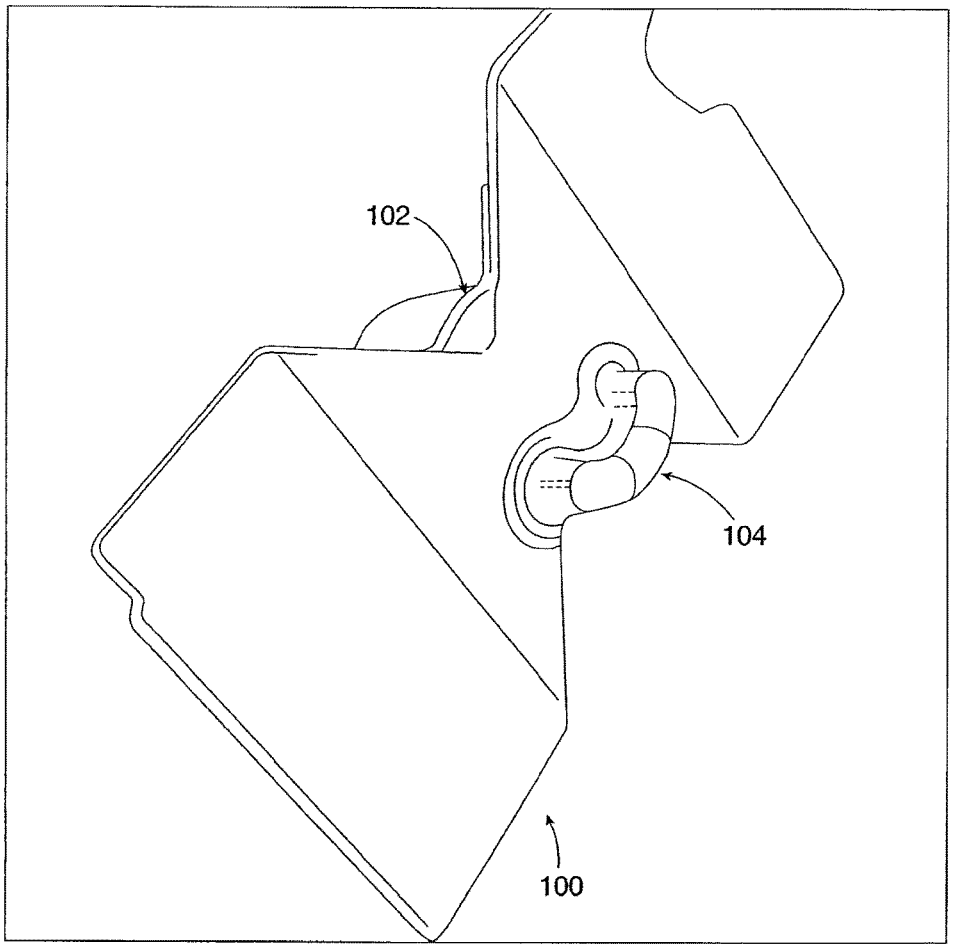
FIG. 18 shows a perspective view of an ejected molded part with a molded section for removal formed from trapping skull material using a plunger tip with a cross section as shown in FIG. 7, in accordance with an embodiment.

FIG. 7 illustrates another example of a plunger tip 22 having a cavity 52 of an alternate rounded configuration. Cavity 52, like cavity 50, is provided at an end of the plunger tip 22 that is configured to at least move molten material from melt zone 12 to mold 16. Cavity 52 may be provided substantially below a centerline of plunger rod 14 and have a rounded configuration that is in the form of an arc or tongue shaped groove, such as shown in FIG. 7. Cavity 52 is configured extend rearwardly from the end of plunger tip 22. Cavity 52 is designed and configured such that much or substantially all of skull material 46 in molten material 42 is trapped in cavity 52 during movement towards mold 16 and/or when the molten material is injected into mold 16, while the higher temperature molten pool 44 of the amorphous alloy material is pushed into mold 16. After the part is formed, the molded part can be ejected and further machining may be used to finalize the molded part. That is, any material that is trapped in cavity 52 of the plunger may be hardened and molded with the part, as shown in FIG. 18. Specifically, FIG. 18 shows a perspective view of a part 100 that has been ejected from a mold in an injection molding machine. Besides having its molded portion 102 that is the final part, the part 100 also includes a molded portion 104 that is hardened within cavity 52 in FIG. 7. This molded portion 104 includes at least some of the skull material 46 that was trapped and/or prevented from being pushed into the mold 16. Thus, molded portion 104 can be machined off of molded portion 102, so that the final part 100 need not include any hardened skull or crystallized material.

FIGS. 8 and 9 illustrate yet another example of a plunger tip 22 with a body 54 having a cavity 56 provided at its end that is configured to at least move molten material from melt zone 12 to mold 16. Cavity 56 may be provided substantially below a centerline of plunger rod 14 and have a stepped configuration. Cavity 56 is configured extend rearwardly from the end of plunger tip 22. Cavity 56 is designed and configured such that much or substantially all of skull material 46 in molten material 42 is trapped in parts of cavity 56 during movement towards mold 16 and/or when the molten material is injected into mold 16, while the higher temperature molten pool 44 of the amorphous alloy material is pushed into mold 16 and molded into a part using cavities 36 and 38. After the part is formed, the molded part can be ejected and further machining may be used to finalize the molded part. That is, any material that is trapped in cavity 56 of plunger body 54 may be hardened and molded with the part. Thus, such material can be machined off, so that the final part need not include any hardened skull or crystallized material.

Of course, the configurations of the cavities shown in FIGS. 5-8 in the plunger tips should be understood to be exemplary and not limiting. Any number of different configurations or geometries could be used to form a cavity in tip 22 of plunger rod 14.

Accordingly, using the concept of a plunger tip that is designed with a cavity, such as those examples shown in FIGS. 5-8, skull material formed in molten material will substantially not enter the cavity(ies) of the mold. Rather, the skull is trapped by the plunger tip (and stays with the part or cookie).

Figure 14:
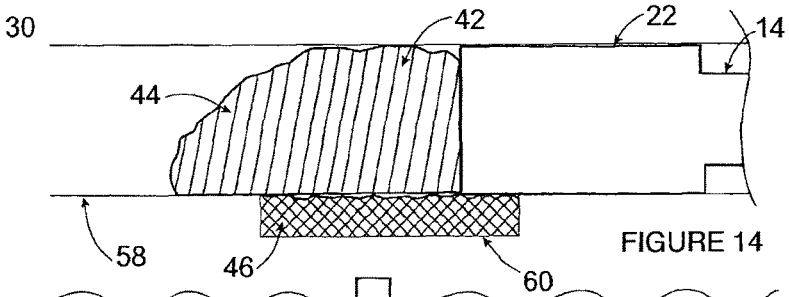
FIGS. 14 and 15 illustrate a detailed, sectional and cross-sectional view of a channel within the injection molding system shown in FIG. 3, in accordance with another embodiment.
Figure 15:
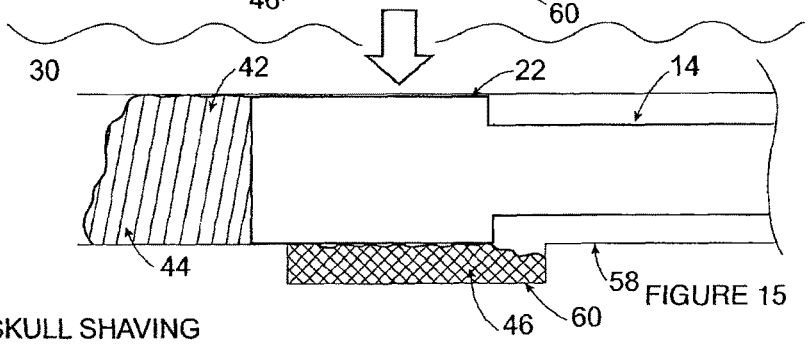

However, parts of the machine or system other than the mold or plunger rod can be configured to remove skull from molten material before it enters the mold. A cavity may be provided outside of the mold or plunger, but still configured to trap the skull material before the plunger moves the molten material into the mold. For example, in a system that includes a transfer sleeve 30 (between the melt zone and the mold), a cavity can be provided in the pathway of the transfer sleeve. Then, as molten material is moved therethrough, the cavity can be used to trap or capture at least some of the skull material. FIGS. 14 and 15 illustrate an example of such a cavity 60 or channel that is provided in a bottom surface 58 of a path in transfer sleeve 30 (for movement of the plunger rod and material therethrough). As generally illustrated, the cavity 60 extends longitudinally in the path (e.g., in a direction along a horizontal axis). Cavity 60 is provided below bottom surface 58 of path such that as plunger rod 14 moves molten material 42 from melt zone 12, skull material 46 is captured within cavity 60, while molten pool 44 is pushed into mold 16. For example, cavity 60 may be in the form of a runner or opening extending longitudinally within the path (e.g., along the X-axis) that is configured to trap skull material before it can enter the molded part region of the mold.

In an embodiment, cavity 60 is configured to be positioned in the path of the transfer sleeve 30 adjacent to the inlet of the mold 16 so that as much skull material 46 that is formed while moving the molten material through the sleeve 30 is captured before injection into the mold 16. However, even though FIGS. 14-15 show transfer sleeve 30 with cavity 60 therein, it should be understood that such a cavity or channel may be provided adjacent or in melt zone 12, and/or at any point before entering the mold. In another embodiment, multiple cavities or channels may be provided along the length of the transfer sleeve. For example, cavities or channels may be longitudinally spaced along the bottom surface to selectively collect or shave skull material from the molten material as it travels along the path.

The depth of the cavity 60 (or cavities) may be between approximately 0.10 mm to approximately 0.25 mm in one embodiment. The depth of the cavity may alternately be between approximately 0.25 mm to approximately 10.0 mm in another embodiment. In another embodiment, the depth of cavity 60 (or cavities) is between 2.0 mm to approximately 5.0 mm. Such dimensions are exemplary and are not limiting. For example, in another embodiment, the depth of the cavity 60 may depend on the amount of material to be collected from the molten material, e.g., which may be a percentage of a total amount of molten material being injected and molded. The depth of the cavity 60 could depend on the speed of the injection, in accordance with another embodiment. Accordingly, any number of factors may be used for determine the dimensions of cavity 60. Accordingly, with implementation of cavity 60, skull material formed in molten material will substantially not enter the cavity(ies) of the mold. Rather, skull is trapped by dropping into the cavity as it is moved through the transfer sleeve.

Figure 16:
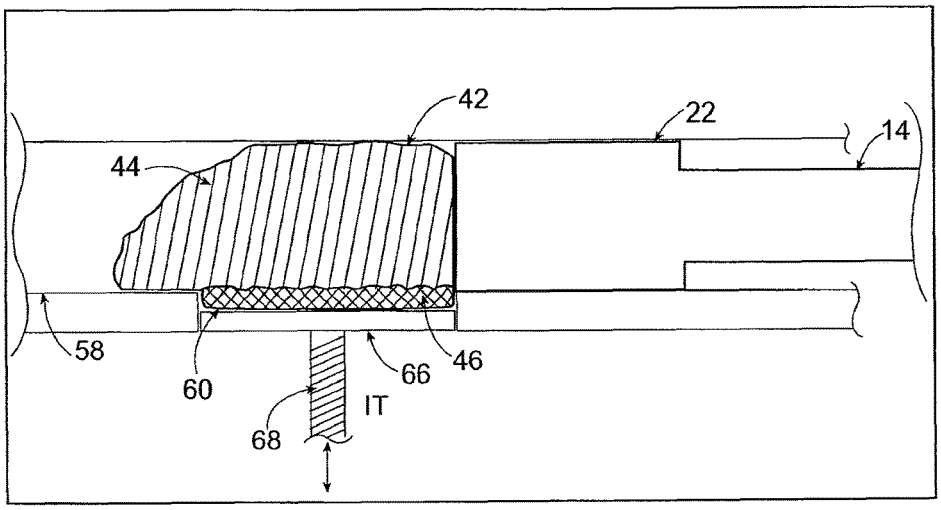
FIGS. 16 and 17 illustrate an exemplary device and method for removing shaved or trapped skull material from a pathway in the injection molding system, in accordance with an embodiment.
Figure 17:
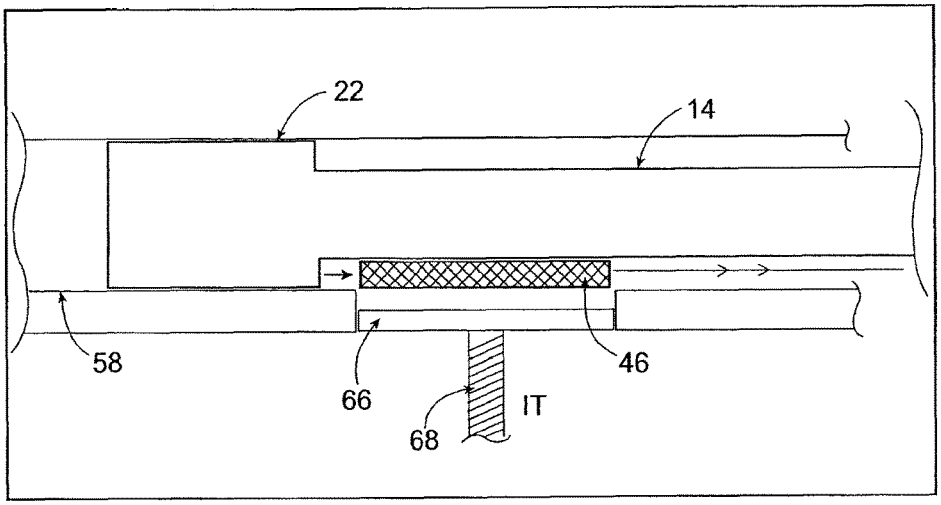

Once material is trapped in cavity 60, any number of means or devices may be used to remove the material. In some instances, the material in cavity 60 may be cooled in order to form a solid piece before it is removed. FIGS. 16 and 17 illustrate exemplary embodiments for using a device in an injection molding system to remove shaved or trapped skull material from a pathway in the injection molding system. In the illustrated embodiment, the ejection device comprises a plate 66 attached to an actuation mechanism 68 (shown in the form of a shaft). Plate 66 is provided in a pathway (e.g., in transfer sleeve 30 between melt zone 12 and mold 16) and is positioned so as to form a cavity beneath the path of the molten pool. For example, plate 66 may be positioned so as to form a cavity similar to cavity 60, as shown in FIG. 16. Plate 66 may be provided at any position and at any depth relative to the pathway.

The material that is trapped in the cavity may be ejected using the illustrated device in a number of ways. For example, the device may be moved upwardly or downwardly. In one embodiment, the actuation mechanism 68 may move the plate 66 in a vertical direction downward and away from the path, causing the material in cavity 60 to be released and/or dropped. In another embodiment, illustrated in FIG. 17, the plate 66 may be moved in a vertical direction upward into the path, causing the material to be pushed upwardly. For example, the plate 66 may be configured to be aligned such that the material can be removed from the pathway. In the embodiment shown in FIG. 17, the plunger 14 is configured to move backwards in a horizontal direction (to a home position, e.g., a position before melting and injection begins) so as to move or push the material backward using its tip 22, e.g., into the melt zone 12. However, the plunger 14 can also or alternatively be used to eject the material from the cavity through the mold 16. For example, before the plate 66 is moved, the plunger 14 may be retracted to its home position. Then, the actuation mechanism 68 can be configured to push the material in the cavity upwardly using plate 66. The plunger 14 can then be moved forwardly towards the mold 16 to move and push the material towards and possibly through the mold for removal.

Alternatively, it is envisioned that, in another embodiment, pins may be provided to eject the material from cavity 60. For example, a plurality of pins may be designed to be selectively moved through a cavity area so that the material in the cavity is pushed out of the cavity (e.g., from the bottom). Such pins may be similar to ejector pins that are used to eject a molded part from a mold cavity, for example.

In accordance with yet another alternative embodiment, parts of the machine or system can be configured to remove the skull from the molten material before entering the mold without removing material from the molten pool 44. For example, FIGS. 10-13 illustrate concepts and methods for using a plunger tip to induce mixing of the molten material (alloy) the before entering the mold (i.e., during movement of the material from the melt zone 12 to the mold 16).

Figure 11:
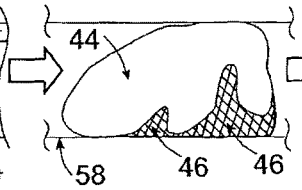
Figure 12:
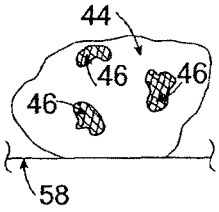

Referencing the devices in injection molding system 10 of FIG. 3, the plunger rod 14 is used to move material from a melt zone 12 towards mold 16 in a horizontal direction from right to left. In an embodiment, to induce and provide mixing of molten material 42, the plunger rod 14 can be pre-programmed to move in a controlled manner to induce mixing or stirring of the material. For example, in an embodiment, the plunger can be periodically stopped along its horizontal path and/or periodically moved in a reciprocal or back and forth motion (e.g., in an opposite direction (e.g., left to right, or backwards and away from the mold) for a short period of time (e.g., 1 sec) before moving again towards mold. Such movement of the plunger rod 14 can induce the molten material to mix. For example, as shown by the arrows in FIG. 10, as the plunger rod 14 pushes material in a horizontal direction through path and along surface 58 of transfer sleeve 30, the molten material 42 may be pouring over its front so that it flows forwardly to mix based on the plunger motion. Then, the turbulence in the molten material 42 causes skull material 46 to be mixed with the higher temperature molten pool 44, as shown in FIG. 11, such that it becomes a part of the molten pool 44. By initiating such stirring, the skull material 46 can be dissolved in the higher temperature pool 44 before it is molded.

Figure 13:
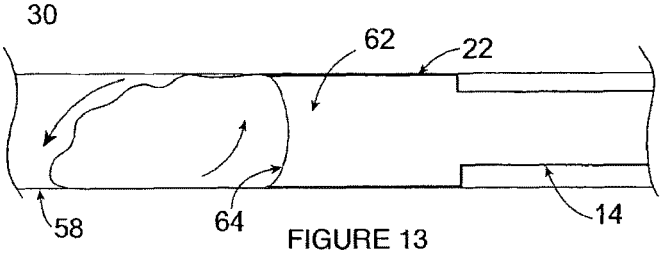
FIG. 13 illustrates a sectional view of an alternate design of a tip of a plunger that may be used in an injection molding system to mix molten material, in accordance with yet another embodiment.
Figure 19:
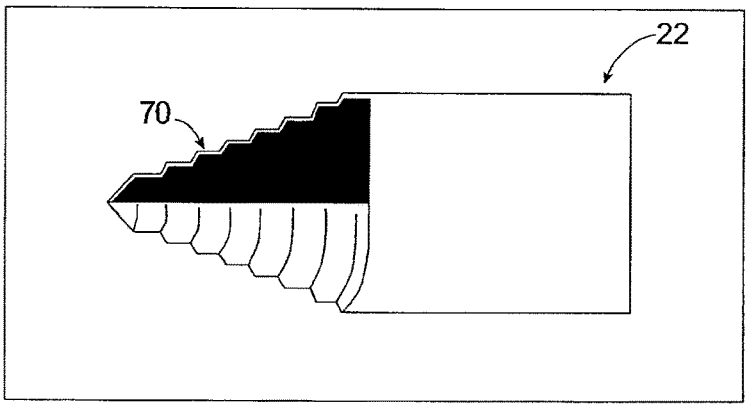
FIGS. 19-21 illustrate alternate designs of different plunger tips that may be used in an injection molding system in accordance with yet another embodiment.
Figure 20:
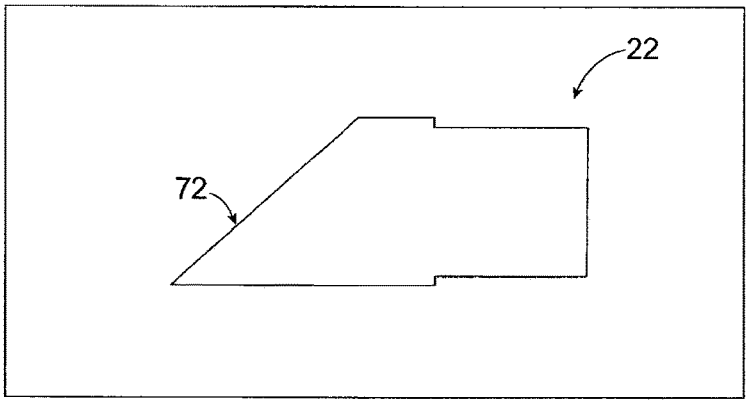
Figure 21:
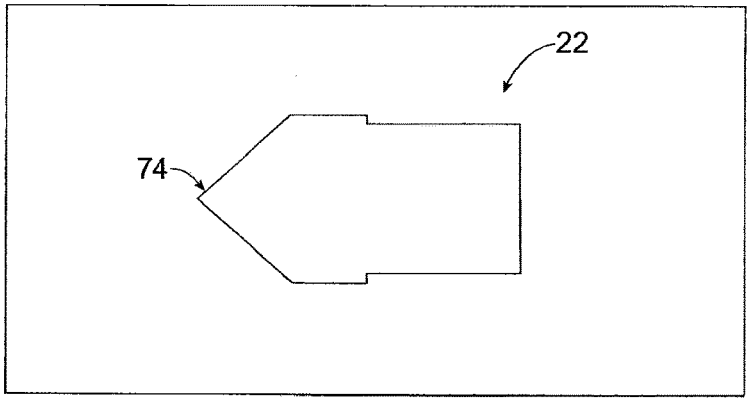

In another embodiment, the tip 22 of the plunger rod 14 may be shaped so that it will induce mixing or stirring in molten material as it moves towards the mold 16. The mixing can be induced by shaping at least the face of the plunger tip so as to stir the molten alloy as a function of the forward movement of the plunger tip and molten pool of material into the mold. FIG. 13 illustrates an example of a plunger tip 22 comprising a body 62 with a contoured end 64 that is configured to push molten material from melt zone 12 and into mold 16. Contoured end 64 may be slightly concaved (as shown) or have a conical shape that is designed to induce mixing and stirring as the plunger rod 14 is moved in the horizontal direction to the mold 16. Such plunger tip designs can also induce movement in the molten material 42 as the plunger is moved, such that it pours over and causes skull material 46 to be mixed with the higher temperature molten pool 44 and can be dissolved in the higher temperature pool 44 before it is molded. FIGS. 19-21 illustrate alternate designs of different plunger tips that may be used in an injection molding system in accordance with other embodiments. In one embodiment, the stirring motion could be angularly rotational around the axis of injection (e.g., horizontal X avis) which could be generated by a screw-shaped tip face 70 of a plunger tip 22, such as shown in FIG. 19. Alternatively, plunger tip 22 may include an inclined plane tip face 72, such as shown in FIG. 20, which can stir the molten fluid from the bottom to the top of the melt by rotating axially. In another embodiment, the stirring could radiate radially from the axis of injection by a conical shaped tip face, such as shown in FIG. 21.

Accordingly, any of these plunger tip designs, devices and/or methods can be used to enhance mixing so that the skull is continually inter-mixed into the molten material. By incorporating and mixing skull material therein while the molten pool is being moved and injected, the amount of skull material present in the final molded part is reduced and/or eliminated.

In some embodiments, it is envisioned that a combination of the herein described implementations may be used in an injection molding machine to substantially reduce and/or substantially eliminate skull material (crystals) in a final, molded part. For example, in an embodiment, it is envisioned that skull material can be trapped by both a cavity in a plunger tip (e.g., see designs in FIGS. 5-8) and a cavity in transfer sleeve (e.g., see FIGS. 14-15). In another embodiment, both a skull trap zone 40 and induced mixing may be used. In yet another embodiment, both induced mixing and one or more cavities may be used to trap skull material.

In addition to the described implementations, additional features of the injection molding system 10 may also be provided in order to reduce an amount of skull material in a final, molded part. For example, it is envisioned that in some instances the pathway walls of transfer sleeve 30 can be made of a certain material to facilitate the skull removal or mitigate skull formation. In some embodiments, the transfer sleeve 300 can be made of a poor thermal conductor material, to reduce cooling and forming of skull in molten material as it is moved by plunger rod 14. In other embodiments, if meltable material can be overheated, the system 10 may be configured to heat the material to a higher temperature, so that skull formation is minimized.

The material that is trapped or removed, and which at least substantially includes the skull, as shown using the methods/devices in FIGS. 4-8 and FIGS. 14-15, for example, need not be wasted or trashed. In some instances, the skull material may be recycled. Because the skull has substantially the same composition as the material (alloy) being melted, the skulls can be combined with meltable material and/or inserted into the melt zone 12 with the meltable material to be re-melted. In some instances, additional constituents may be added, as needed.

The herein described configurations would not require a difference in materials from other materials known for forming parts in the machine. In some embodiments, coatings and/or texture may be added (e.g., in the transfer sleeve) to improve wear resistance and reduce heat loss.

The above described methods and systems reduce and/or minimize skull formation and/or remove any skull formed during processing. Accordingly, the skull in the final molded product is reduced and/or minimized. In some cases, it may be substantially eliminated from the final molded product. Reducing the amount of skull or crystallized material in molded parts increases quality, including but not limited to: strength related properties, cosmetic properties, corrosion resistance, and amorphous uniformity.

Generally, to form a part (e.g., bulk amorphous alloy part) using meltable material (e.g., amorphous alloy), the injection molding system/apparatus 10 may be operated in the following manner: Meltable material (e.g., amorphous alloy or BMG in the form of an ingot) is loaded into a feed mechanism (e.g., loading port 18 or device), inserted and received into the melt zone 12 into the vessel 20 (surrounded by the induction coil 26). A vacuum is applied to the system (melt zone and mold), and the material is heated through the induction process in melt zone 12 (i.e., by supplying power via a power source to induction coil 26). The injection molding machine can control the temperature through a closed loop system, which will stabilize the material at a specific temperature (e.g., using a temperature sensor and a controller). During melting of the material, the apparatus is maintained under vacuum. Also during heating/melting, a cooling system can be activated to flow a (cooling) liquid in any cooling line(s) of the vessel 20. Once the desired temperature is achieved and maintained to melt the meltable material, the heating using induction coil 26 can be stopped. The machine will then begin the injection of the molten material from vessel 20, through transfer sleeve 30, and into vacuum mold 16 by moving it in a horizontal direction (from right to left) along the horizontal axis (X axis). This may be controlled using plunger 14, which can be activated using a servo-driven drive or a hydraulic drive. The mold 16 is configured to receive molten material through an inlet and configured to mold the molten material under vacuum. That is, the molten material is injected into a cavity between the at least first and second plates to mold the part in the mold 16. In one embodiment, at least part of the molten material is trapped in a cavity of the injection molding apparatus. Specifically, skull material from the molten material is trapped or captured using any singular or combination of the configurations of the mold, plunger tips, and/or transfer sleeve as described with reference to FIGS. 4-8 and 14-15. In another embodiment, mixing of the molten material is induced (e.g., using the plunger) so that skull material is substantially prevented from forming and/or any skull that does form is mixed and melted in the molten pool. Then, material is injected into the mold. Once the mold cavity has begun to fill, vacuum pressure (via the vacuum lines and vacuum source 38) can be held at a given pressure to "pack" the molten material into the remaining void regions within the mold cavity and to mold the material. After the molding process (e.g., approximately 10 to 15 seconds), the vacuum pressure applied to at least the mold 16 (if not the entire apparatus 10) is released. Mold 16 is then opened to relieve pressure and to expose the part to the atmosphere. An ejector mechanism is actuated to eject the solidified, molded object from between the at least first and second plates of mold 16 via an actuation device. Thereafter, the process can begin again. Mold 16 can then be closed by moving at least the at least first and second plates relative to and towards each other such that the first and second plates are adjacent each other. The melt zone 12 and mold 16 is evacuated via the vacuum source once the plunger 14 has moved back into a load position, in order to insert and melt more material and mold another part. The ejected molded part can be machined, as needed, to produce a finalized, molded part that has a reduction in and/or is substantially free from hardened skull material.

Accordingly, the herein disclosed embodiments illustrate skull trapping methods and devices in an exemplary injection system that has its melting system in-line along a horizontal axis. However, it is envisioned that some of the herein described embodiments may also be implemented in a system positioned on a vertical axis.

Although not described in detail, the disclosed injection system may include additional parts including, but not limited to, one or more sensors, flow meters, etc. (e.g., to monitor temperature, cooling water flow, etc.), and/or one or more controllers. Also, seals can be provided with or adjacent any of number of the parts to assist during melting and formation of a part of the molten material when under vacuum pressure, by substantially limiting or eliminating substantial exposure or leakage of air. For example, the seals may be in the form of O-rings. A seal is defined as a device that can be made of any material and that stops movement of material (such as air) between parts which it seals. The injection system may implement an automatic or semi-automatic process for inserting meltable material therein, applying a vacuum, heating, injecting, and molding the material to form a part.

The types and materials used for plungers, the transfer sleeve, or the mold in any of the illustrative embodiments herein is not meant to be limited. The plunger rod and its tip may be made of similar or different materials. For example, common materials used for forming the plunger rod body are harden tool steel(s). For the plunger tip, one or more non-ferrous machineable materials such as copper, copper alloys, copper beryllium alloys, stainless steel, brass, tungsten, or a variety of high-temperature and high strength ceramics, and/or the like may be used. In some embodiments, the plunger body and/or tip may have a coating thereon (e.g., a coating of carbide, nitride, ceramic, etc.) to promote high wear resistance, provide thermal barriers for the purpose of increasing plunger tip lifetime, and/or improving the melt homogeneity. A plunger tip could also be coated with a softer material to provide better sliding mechanics between the plunger tip and the boat and/or cold sleeve material. Plunger tip coatings could be ceramic or metallic in nature, and deposited in a wide variety of methods including chemical bath, vapor deposition, powder coating, etc. In some embodiments, the material used to form the plunger tip material is non-magnetic. A plunger tip could also be formed from multiple parts or pieces, such as consisting of a stronger body portion and a replaceable tip portion (e.g., which may contain or be formed from a material with ample properties for contact with molten material).

Furthermore, it should be noted that any of the herein described embodiments of plunger rods and plunger tips as shown in FIGS. 5-8 and 13-15 may be configured to be temperature controlled or cooled in some way, e.g., using a fluid.

In some embodiments, the material to be molded (and/or melted) using any of the embodiments of the injection system as disclosed herein may include any number of materials and should not be limited to amorphous alloys. In some embodiments, any of the plungers described herein may be used to move materials other than amorphous alloys.

While the principles of the disclosure have been made clear in the illustrative embodiments set forth above, it will be apparent to those skilled in the art that various modifications may be made to the structure, arrangement, proportion, elements, materials, and components used in the practice of the disclosure.

It will be appreciated that many of the above-disclosed and other features and functions, or alternatives thereof, may be desirably combined into many other different systems/devices or applications. Various presently unforeseen or unanticipated alternatives, modifications, variations, or improvements therein may be subsequently made by those skilled in the art which are also intended to be encompassed by the following claims.

What is claimed is:

1. An injection molding system comprising:

a melt zone configured to melt amorphous alloy received therein, thereby forming a molten amorphous alloy;

a mold for molding the molten amorphous alloy;

a plunger configured to move the molten amorphous alloy from the melt zone into the mold;

a transfer sleeve extending between the melt zone and the mold; and a cavity positioned in a bottom portion of an interior surface of the transfer sleeve, extending to a depth less than a complete thickness of the transfer sleeve, along less than a complete circumference of the interior surface and configured to trap skull material from the molten amorphous alloy prior to the molten amorphous alloy being injected into the mold.

2. The system according to claim 1, further comprising another cavity defined by the mold.

3. The system according to claim 1, further comprising another cavity defined by a tip of the plunger.

4. The system according to claim 3, wherein:

the plunger is configured to move along a horizontal axis; and the another cavity is below a horizontal centerline of the plunger.

5. The system according to claim 3, wherein the another cavity has a shape defined by a stepped cross-section.

6. The system according to claim 3, wherein the another cavity has a shape defined by a rounded cross-section.

7. The system of claim 1 further comprising another cavity positioned in the melt zone.

8. The system of claim 7 wherein the melt zone comprises a vessel and the another cavity is positioned in the bottom portion of an interior surface of the vessel.

9. The system of claim 7 wherein the vessel is positioned along a horizontal axis.

10. The system according to claim 1, further comprising an ejection mechanism comprising a plate defining a bottom surface of the cavity and configured to eject the skull material from the cavity.

11. The system of claim 10, wherein the transfer sleeve extends longitudinally along a horizontal axis.

12. The injection molding system of claim 10, wherein the cavity is positioned adjacent to an inlet of the mold.

13. The system according to claim 1, wherein the transfer sleeve extends longitudinally along a horizontal axis.

14. The system according to claim 1, wherein the melt zone comprises a vessel positioned along a horizontal axis.

15. The system according to claim 14, wherein the vessel comprises one or more temperature regulating lines configured to flow a liquid therein for regulating a temperature of the vessel during melting of the amorphous alloy.

16. The system according to claim 1, further comprising an induction coil associated with the melt zone and configured to melt the amorphous alloy.

17. A method of making a bulk amorphous alloy part comprising:

disposing an amorphous alloy within a melt zone of an injection molding apparatus;

melting the amorphous alloy in the melt zone, thereby forming a molten amorphous alloy;

moving the molten amorphous alloy through a transfer sleeve and into a mold using a plunger, the transfer sleeve extending between the melt zone and the mold;

trapping skull material from the molten amorphous alloy in a cavity positioned in a bottom portion of an interior surface of the transfer sleeve, and having a depth less than a complete thickness of the transfer sleeve, and along less than a complete circumference of the interior surface; and molding the molten amorphous alloy into a bulk amorphous alloy part.

18. The method according to claim 17, wherein the operation of moving the molten amorphous alloy using the plunger comprises moving the plunger in a horizontal direction.

19. The method according to claim 17, wherein the operation of melting the amorphous alloy comprises powering an induction source to melt the amorphous alloy in the melt zone.

20. An injection molding system comprising:

a melt zone configured to melt amorphous alloy received therein, thereby forming a molten amorphous alloy;

a mold for molding the molten amorphous alloy;

a plunger configured to move the molten amorphous alloy from the melt zone into the mold;

a transfer sleeve extending between the melt zone and the mold;

a cavity at least partially defined by an interior surface of the transfer sleeve and configured to trap skull material from the molten amorphous alloy prior to the molten amorphous alloy being injected into the mold; and an ejection mechanism configured to eject the skull material from the cavity.

21. The system according to claim 20, wherein the ejection mechanism comprises a plate defining a bottom surface of the cavity.

22. The system according to claim 20, wherein the ejection mechanism comprises a plurality of pins in a bottom surface of the cavity configured to eject the skull material out of the cavity.

23. The system according to claim 20, wherein the transfer sleeve extends longitudinally along a horizontal axis and the cavity is positioned in a bottom surface of the interior surface of the transfer sleeve.

* * * * *